US011655998B2

(12) United States Patent
Liu et al.

(10) Patent No.: US 11,655,998 B2
(45) Date of Patent: May 23, 2023

(54) PANEL ASSEMBLY FOR AIR CONDITIONER AND WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Yu Liu, Foshan (CN); Zhigang Xing, Foshan (CN); Kangwen Zhang, Foshan (CN); Zhisheng Lei, Foshan (CN); Hui Yu, Foshan (CN); Yuhang Tang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 425 days.

(21) Appl. No.: 16/497,918

(22) PCT Filed: Mar. 28, 2019

(86) PCT No.: PCT/CN2019/080149
§ 371 (c)(1),
(2) Date: Sep. 26, 2019

(87) PCT Pub. No.: WO2020/155356
PCT Pub. Date: Aug. 6, 2020

(65) Prior Publication Data

US 2021/0356167 A1 Nov. 18, 2021

(30) Foreign Application Priority Data

Feb. 3, 2019 (CN) ..... 201910108803.1
Feb. 3, 2019 (CN) ..... 201920188030.8
Feb. 3, 2019 (CN) ..... 201920188048.8

(51) Int. Cl.
*F24F 13/20* (2006.01)
*F24F 1/031* (2019.01)
(Continued)

(52) U.S. Cl.
CPC ..... *F24F 13/20* (2013.01); *F24F 1/0284* (2019.02); *F24F 1/031* (2019.02); *F24F 1/035* (2019.02); *F24F 1/0323* (2019.02)

(58) Field of Classification Search
CPC ..... F24F 13/20; F24F 1/031; F24F 1/0323; F24F 1/0284; F24F 1/035; F24F 1/0011
See application file for complete search history.

(56) References Cited

U.S. PATENT DOCUMENTS 3,592,123 A * 7/1971 Henken ..... F24F 13/20 62/262
2005/0274135 A1 12/2005 Kim et al.
(Continued)

FOREIGN PATENT DOCUMENTS

CN 101957027 A 1/2011
CN 101995059 A 3/2011
(Continued)

OTHER PUBLICATIONS

CN-102003746-A Translation (Year: 2011).*
(Continued)

*Primary Examiner* — Schyler S Sanks
(74) *Attorney, Agent, or Firm* — Anova Law Group PLLC

(57) ABSTRACT

A panel assembly for an air conditioner includes a face frame and an air inlet panel. The face frame includes an air inlet and an air outlet located above the air inlet. An air outlet surface of the air outlet extends obliquely backward in a direction from bottom to top. The air outlet surface is a plane
(Continued)

on which an end surface of the air outlet is located. The air inlet panel is provided at the air inlet.

9 Claims, 24 Drawing Sheets

(51) Int. Cl.
*F24F 1/0323* (2019.01)
*F24F 1/0284* (2019.01)
*F24F 1/035* (2019.01)

(56) References Cited

U.S. PATENT DOCUMENTS

| | | | | |
|---|---|---|---|---|
| 2007/0079628 | A1* | 4/2007 | Han | F24F 1/005 62/262 |
| 2009/0241576 | A1* | 10/2009 | Tsuji | F24F 1/005 454/358 |
| 2016/0102460 | A1* | 4/2016 | West | H02S 20/23 52/58 |

FOREIGN PATENT DOCUMENTS

| | | | |
|---|---|---|---|
| CN | 102003746 A | * | 4/2011 |
| CN | 102003746 A | | 4/2011 |
| CN | 101995059 B | | 4/2014 |
| CN | 102003746 B | | 4/2014 |
| CN | 106403241 A | | 2/2017 |
| CN | 207146655 U | | 3/2018 |
| JP | 2019093378 A | | 6/2019 |
| WO | 2020155356 A1 | | 8/2020 |

OTHER PUBLICATIONS

World Intellectual Property Organization (WIPO) Written Opinion for PCT/CN2019/080149 dated Nov. 4, 2019 7 Pages.
Canadian Intellectual Property Office The Office Action For CA Application No. 3057122 dated Jul. 23, 2021 5 Pages.
World Intellectual Property Organization (WIPO) International Search Report for PCT/CN2019/080149 dated Nov. 4, 2019 18 Pages.
Canadian Intellectual Property Office The Office Action For CA Application No. 3057122 dated Feb. 8, 2021 6 Pages.
World Intellectual Property Organization (WIPO) Written Opinion for PCT/CN2019/080149 dated Nov. 4, 2019 6 Pages.

* cited by examiner

PANEL ASSEMBLY FOR AIR CONDITIONER AND WINDOW AIR CONDITIONER

CROSS-REFERENCE TO RELATED APPLICATIONS

This application is a National Stage Entry under 35 U.S.C. § 371 of International Application No. PCT/CN2019/080149, filed on Mar. 28, 2019, which is based on and claims priority to Chinese Patent Application Serial No. 201920188030.8, No. 201910108803.1, and No. 201920188048.8, all filed on Feb. 3, 2019, the entire contents of all of which are incorporated herein by reference.

FIELD

The disclosure relates to a field of air conditioning technology, in particular to a panel assembly of an air conditioner and a window air conditioner.

BACKGROUND

In related art, an unreasonable arrangement of an air outlet of an air conditioner results in direct air blowing towards users, which makes people feel uncomfortable, and a flow path of air in the air conditioner is relatively long, causing large air flow loss. In addition, because the air conditioner generally has a large air inlet, a face frame of the air conditioner is prone to deform, affecting the usage and appearance.

SUMMARY

The present disclosure seeks to solve at least one of the technical problems existing in the related art. Therefore, one objective of the present disclosure is to propose a panel assembly for an air conditioner, and the panel assembly can increase an air blowing distance and an air output area and can prevent deformation of a face frame.

The present disclosure also proposes a window air conditioner having the panel assembly mentioned above.

According to embodiments of a first aspect of the present disclosure, the panel assembly includes: a face frame formed with an air inlet and an air outlet, the air outlet being located above the air inlet, a plane where the air outlet is located being configured as an air outlet surface, and the air outlet surface extending obliquely backward in a direction from bottom to top; an air inlet panel provided at the air inlet and having a mesh shape, a plurality of air intake holes being distributed in the air inlet panel; and a reinforcing support having a hollow structure, provided at the air inlet, and located at an inner side of the air inlet panel, the reinforcing support being connected with the face frame.

With the panel assembly according to the embodiments of the present disclosure, with the air outlet being arranged above the air inlet and configuring the air outlet surface of the air outlet to extend obliquely backward in the direction from bottom to top, the length of the air channel can be reduced when the panel assembly is applied to the air conditioner, thereby shortening the length of the flow path in the air channel and reducing the air flow loss; the air blowing distance can be increased; and moreover, the air outlet can blow air obliquely upward to prevent the cold air from being directly blown towards persons. Meanwhile, the air output area can be enlarged, and the working performance of the air conditioner can be improved. In addition, with the air inlet panel being provided at the air inlet, external dust and other impurities are prevented from entering the air conditioner. Additionally, the reinforcing support can improve the structure strength of the face frame to prevent the face frame from deforming.

According to some embodiments of the present disclosure, an included angle between the air outlet surface and a vertical direction is $\alpha$, and the $\alpha$ satisfies: $50° \leq \alpha \leq 66°$.

According to some embodiments of the present disclosure, the reinforcing support includes a plurality of first support rods spaced apart along a left-right direction, and each extending along an up-down direction; and at least one second support rod extending along the left-right direction, the plurality of first support rods being connected with the second support rod.

According to some embodiments of the present disclosure, the air inlet panel is detachably provided at the air inlet.

According to some optional embodiments of the present disclosure, an upper end of the air inlet panel is formed with a plurality of first snaps spaced apart along the left-right direction, and the face frame is formed with a plurality of second snaps snapped with the plurality of first snaps in one-to-one correspondence, the second snap being supported on the first snap, and a snapping portion of second snap being located on a front side of and abutting against a snapping portion of the first snap; a lower end of the air inlet panel is formed with a plurality of third snaps spaced apart along the left-right direction, and the face frame is formed with a plurality of fourth snaps snapped with the third snaps in one-to-one correspondence, the third snap being supported on the fourth snap, and a snapping portion of the fourth snap being located on a front side of and abutting against a snapping portion of the third snap.

Optionally, the snapping portion of at least one third snap has a first guide surface, and the snapping portion of at least one fourth snap has a second guide surface cooperating with the first guide surface, both of the first guide surface and the second guide surface being configured as curved surfaces.

Optionally, a top of the air inlet panel is formed with a first flange part extending backwards, and the first flange part is suitable to abut a top wall of the air inlet; a bottom of the air inlet panel is formed with a second flange part extending backwards, and the second flange part abuts against a front wall of the face frame.

Optionally, the air inlet panel is formed with a plurality of positioning columns, and the plurality of positioning columns are distributed at a left end and a right end of the air inlet panel; the face frame is formed with a plurality of positioning holes fitted with the plurality of positioning columns in one-to-one correspondence.

Further, an outer peripheral wall of at least one of the positioning columns is formed with a first limiting protrusion, and an inner peripheral wall of at least one of the positioning holes is formed with a second limiting protrusion cooperating with the first limiting protrusion, wherein the second limiting protrusion is located on a front side of the first limiting protrusion and abuts against the first limiting protrusion.

According to embodiments of a second aspect of the present disclosure, a window air conditioner includes: an indoor part and an outdoor part connected with the indoor part. The indoor part includes: an indoor housing including the panel assembly according to the embodiments of the first aspect of the present disclosure; a volute provided in the indoor housing and defining an air channel in communication with both of the air inlet and the air outlet, the air channel extending to the air outlet; a fan wheel provided in the air channel; and an indoor heat exchanger provided in the indoor housing and arranged opposite to the air inlet.

For the window air conditioner according to the embodiments of the present disclosure, with the above panel assembly, the air blowing distance and the air output area of the air conditioner can be increased, and the deformation of the air inlet panel at the inlet can be prevented.

According to some embodiments of the present disclosure, the window air conditioner includes an air guide plate configured to open and close the air outlet, provided in the air channel, and rotatably connected with the volute.

According to some embodiments of the present disclosure, the window air conditioner includes an air guide assembly provided in the air channel and downstream of the fan wheel, the air guide assembly including a plurality of louvers spaced apart along a left-right direction, and each louver being rotatably connected with the volute.

Further, the air guide assembly includes a connecting rod extending along the left-right direction and being movable along the left-right direction, each of the louvers being rotatably connected with the connecting rod; and a shifting block provided in the air channel and being swingable leftwards and rightwards, the shifting block being connected with the connecting rod or any one of the louvers.

According to some embodiments of the present disclosure, the window air conditioner includes an air guide assembly provided in the air channel and located downstream of the fan wheel; and a protecting mesh provide din the air channel and located downstream of the air guide assembly, at least a part of the protecting mesh being recessed inwardly.

Optionally, the protecting mesh includes a first mesh section parallel to an air outlet surface, the air outlet surface being a plane where an end surface of the air outlet end is located; a second mesh section located upstream of the first mesh section, and having a first end connected with the first mesh section and a second end extending inwards, the second mesh section and the first mesh section being at an angle to each other; and a third mesh section located upstream of the second mesh section, the third mesh section and the first mesh section being located on both sides of the second mesh section, the second end of the second mesh section being connected with the third mesh section, and the third mesh section and the second mesh section being at angle to each other.

Further, the third mesh section extends obliquely inward in a direction from the second mesh section to the third mesh section.

Optionally, the air guide assembly includes: a plurality of louvers spaced apart along a left-right direction, each of the louvers being rotatably connected with the volute; a connecting rod extending along the left-right direction and being movable along the left-right direction, each of the louvers being rotatably connected with the connecting rod; and a shifting block provided in the air channel and being swingable leftwards and rightwards, the shifting block being connected with the connecting rod or any one of the louvers, the protecting mesh being formed with an operation opening corresponding to the shifting block.

According to some embodiments of the present disclosure, the volute includes a first volute and a second volute cooperating with each other, the first volute and the second volute define the air channel therebetween, and both of the first volute and the second volute are independently molded parts.

According to some embodiments of the present disclosure, the volute includes a first volute and a second volute cooperating with each other, the second volute is located at a rear side of the first volute, and the first volute and the second volute define the air channel therebetween. The air channel assembly includes a fan wheel provided in the air channel and located upstream of the air guide assembly. The second volute includes a first volute section and a second volute section connected in an up-down direction, the first volute section is opposite to the first volute and the fan wheel, and the second volute section is constituted by a part of the second volute below the fan wheel and extends straightly.

According to some embodiments of the present disclosure, the indoor heat exchanger includes a first heat exchange section and a second heat exchange section connected with each other, and the first heat exchange section and the second heat exchange section have an included angle therebetween. The window air conditioner further includes a filter screen located on a side of the indoor heat exchanger adjacent to the air inlet, the filter screen includes a first filter section and a second filter section connected with each other, the first filter section is opposite to and spaced apart from the first heat exchange section, and the second filter section is opposite to and spaced apart from the second heat exchange section.

Further, a distance between the first filter section and the first heat exchange section is d1, a distance between the second filter section and the second heat exchange section is d2, and the d1 and the d2 satisfy: $0.9 \leq d1/d2 \leq 1.2$.

According to some embodiments of the present disclosure, the window air conditioner is supported in a window opening of a wall, and a movable window is provided in the window opening. The window air conditioner includes: a chassis, the indoor part and the outdoor part being both arranged on the chassis, a receiving groove being defined among the indoor part, the outdoor part and the chassis, and at least a part of the window being able to extend into the receiving groove.

According to some embodiments of the present disclosure, the window air conditioner includes a sealing assembly, and the sealing assembly contacts the window and an inner wall of the window opening separately. The sealing assembly includes a first connecting member of a variable length, including a fixing member and a slide block, at least a part of the fixing member being arranged in the receiving groove, and the slide block slidably cooperating with the fixing member; and a plurality of second connecting members, any one of the second connecting members being detachably connected with the slide block, and any two of the second connecting members being detachably connected with each other so as to adjust a length of the sealing assembly.

According to some embodiments of the present disclosure, the window air conditioner includes an intermediate partition plate fixed on the chassis and located in the receiving groove, the sealing assembly further including a rotating bracket fixed to the intermediate partition plate, the fixing member being rotatably provided at the rotating bracket to allow the sealing assembly to rotate to be stored in the receiving groove.

Further, the sealing assembly further includes an angular positioning assembly, the angular positioning assembly includes a positioning protrusion and a plurality of positioning recesses, the positioning protrusion is provided at the fixing member, and the plurality of positioning recesses are provided in the rotating bracket and arranged into a circular ring shape; when the rotating bracket is rotated, the positioning protrusion can be switchably fitted with the plurality of positioning recesses, and when the positioning protrusion is fitted with one of the positioning recesses, the fixing member is positioned.

According to some embodiments of the present disclosure, the sealing assembly further includes a slide positioning assembly, and the slide positioning assembly is provided at the fixing member and cooperates with the slide block to position the slide block in a current position.

Optionally, the fixing member is provided with a sliding cavity therein, and at least a part of the slide block extends into the sliding cavity.

Further, the slide positioning assembly is configured as a rotating member, the rotating member is rotatably provided through the fixing member and is threadedly fitted with the fixing member, the rotating member rotates to adjust a length of a portion of the rotating member that extends into the sliding cavity, and the rotating member can abut against the slide block to position the slide block.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

Figure 1:
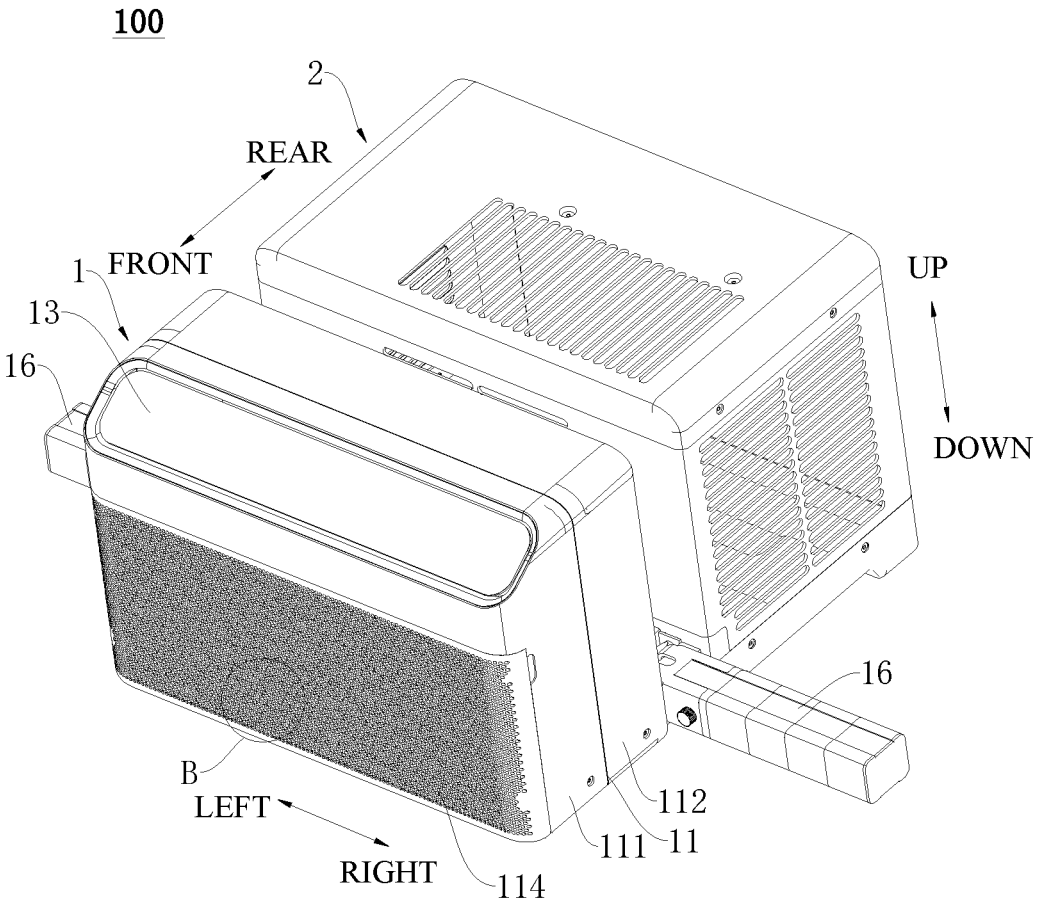
FIG. 1 is a perspective view of a window air conditioner according to an embodiment of the present disclosure.
Figure 2:
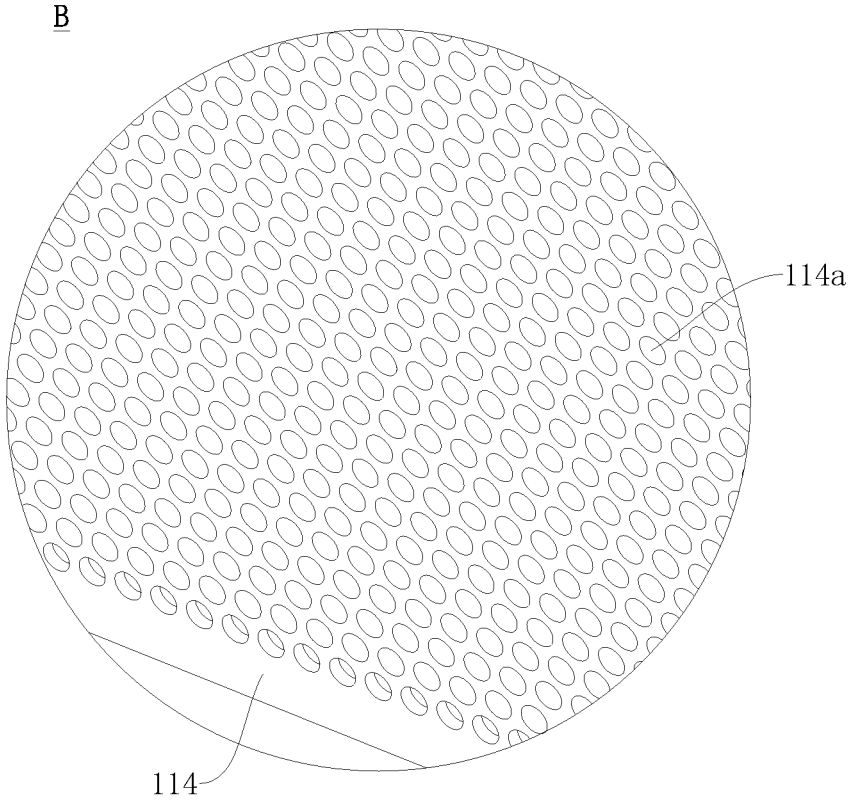
FIG. 2 is an enlarged view of part B in FIG. 1.

DRAWING REFERENCE window air conditioner 100;

indoor part 1;

indoor housing 11; face frame 111; air inlet 111*a*; air outlet 111*b*; rear case 112; reinforcing support 113; first support rod 1131; second support rod 1132; air inlet panel 114; air intake hole 114*a;* first snap 10; snapping portion 101; second snap 20; snapping portion 201; third snap 30; snapping portion 301; first guide surface 302; fourth snap 40; snapping portion 401; second guide surface 402; positioning column 50; first limiting protrusion 501; positioning hole 60; second limiting protrusion 601; first flange part 70; second flange part 80;

volute 12; first volute 121; second volute 122; first volute section 1221; second volute section 1222; air channel 12*a*; air outlet end 11*a;* air guide plate 13;

fan wheel 14;

indoor heat exchanger 15; first heat exchange section 151; second heat exchange section 152;

sealing assembly 16; first connecting member 161; fixing member 1611; sliding cavity 1611*a*; positioning protrusion 1611*b*; slide block 1612; second connecting member 162; insertion part 1621; insertion chamber 162*a*; rotating bracket 163; positioning recess 163*a*; slide positioning assembly 164; sealing end cover 165;

louver 171; connecting rod 172; shifting block 173;

protecting mesh 18; first mesh section 181; operation opening 1811; second mesh section 182; third mesh section 183;

filter screen 19; first filter section 191; second filter section 192;

outdoor part 2;

chassis 3, intermediate partition plate 4, receiving groove s.

DETAILED DESCRIPTION

Embodiments of the present disclosure will be described in detail below, and examples of the embodiments will be shown in the drawings, wherein the same or similar elements and the elements having same or similar functions are denoted by like reference numerals throughout the descriptions. The embodiments described below with reference to drawings are explanatory, illustrative, and used to generally understand the present disclosure. The embodiments shall not be construed to limit the present disclosure.

A panel assembly for an air conditioner according to embodiments of the present disclosure will be described below with reference to FIGS. 1-4.

Figure 4:
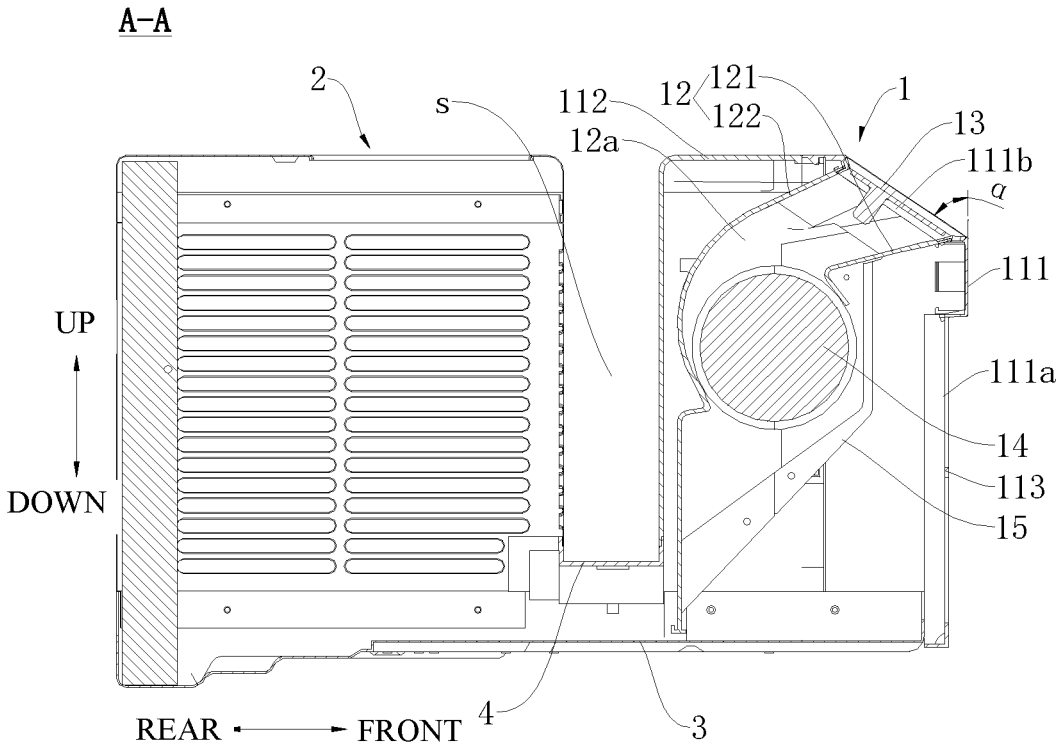
FIG. 4 is a sectional view along line A-A in FIG. 3.
Figure 5:
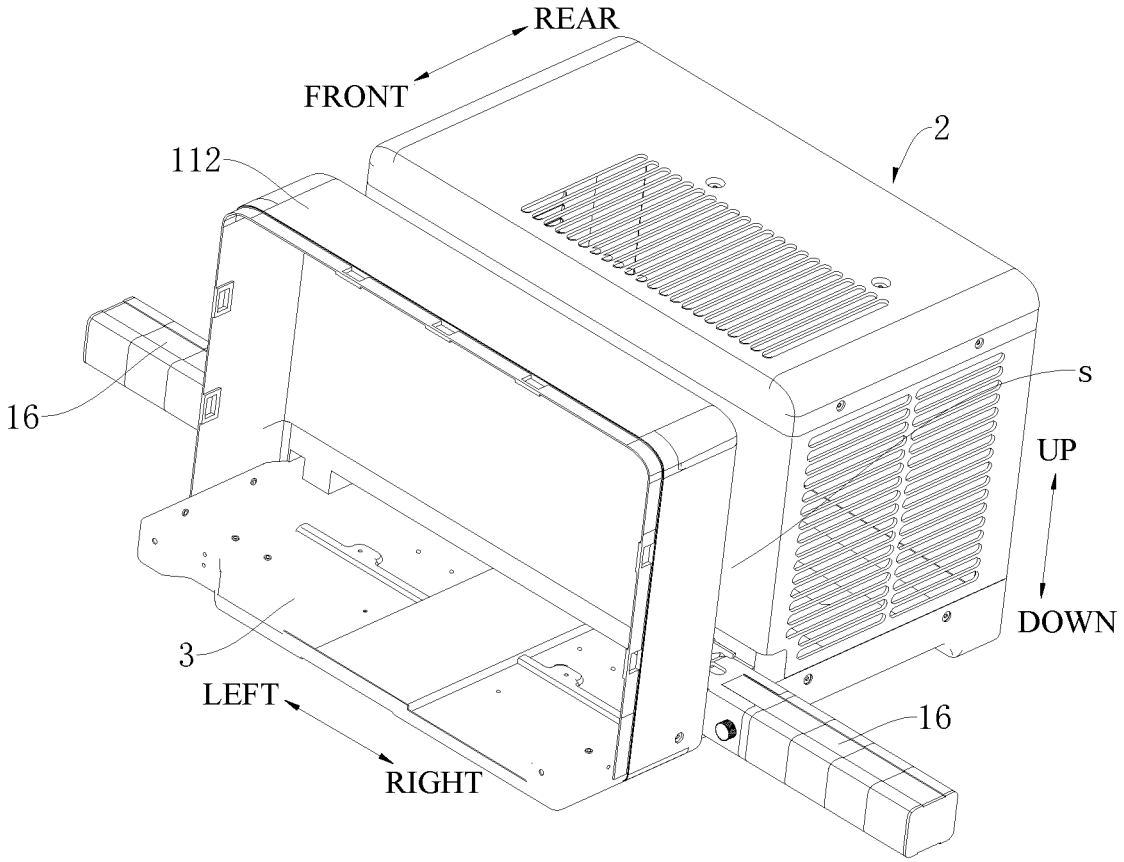
FIG. 5 is a perspective view of a partial structure of a window air conditioner according to an embodiment of the present disclosure.
Figure 6:
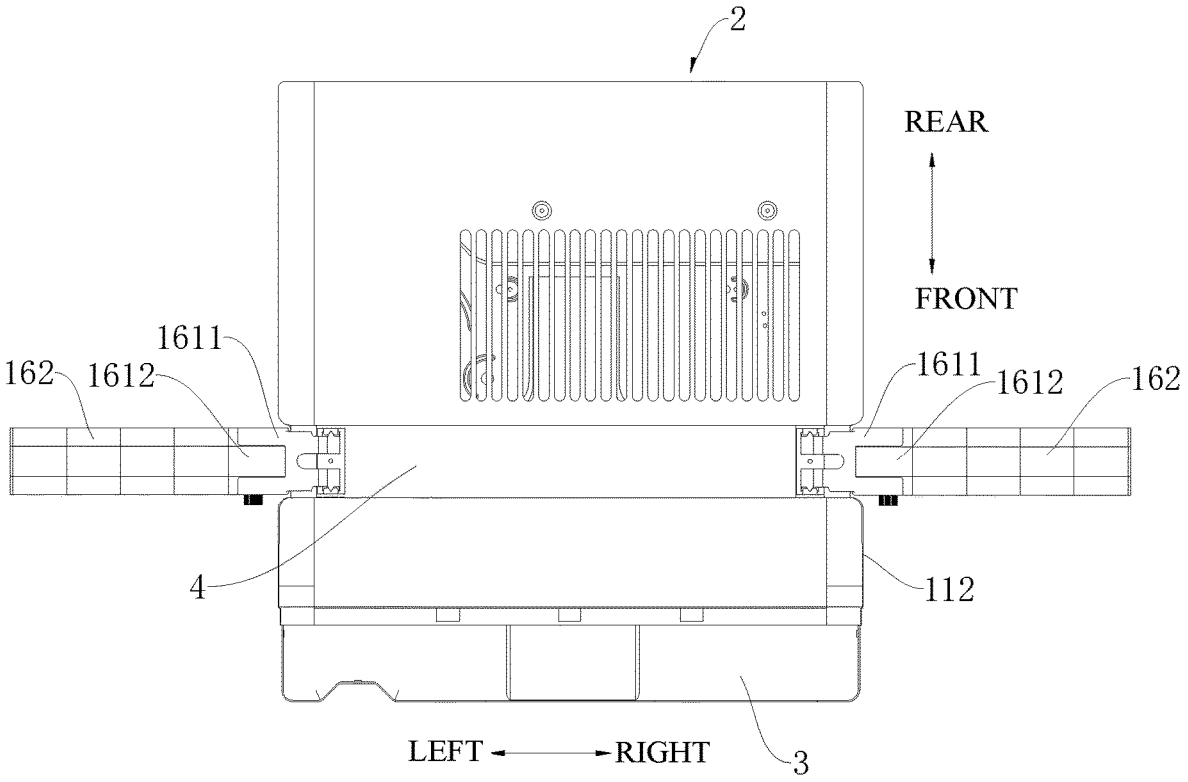
FIG. 6 is a top view of the structure of the window air conditioner in FIG. 5.

As shown in FIGS. 1 and 4, the panel assembly according to embodiments of a first aspect of the present disclosure includes a face frame 111, an air inlet panel 114, and a reinforcing support 113.

The face frame 111 is formed with an air inlet 111*a* and an air outlet 111*b*, and the air outlet 111*b* is located above the air inlet 111*a*. A plane where the air outlet 111*b* is located is an air outlet surface, and the air outlet surface extends obliquely backward in a direction from bottom to top. Thus, with the air outlet 111*b* being arranged above the air inlet 111*a* and the air outlet surface of the air outlet 111*b* being configured to extend obliquely backward in the direction from bottom to top, a length of an air channel 12*a* can be shortened when the panel assembly is applied to the air conditioner. Thus, a length of a flow path in the air channel 12*a* can be shortened, air flow loss can be reduced, and an air blowing distance can be increased. Moreover, the air outlet 111*b* blows air obliquely upward to prevent cold air from being directly blown towards users. At the same time, an air output area can be enlarged, and working performance of the air conditioner can be improved.

The air inlet panel 114 is provided at the air inlet 111*a*. The air inlet panel 114 is mesh-shaped. A plurality of air intake holes 114*a* are uniformly distributed in the air inlet panel 114, and the air intake hole 114*a* can have a circular cross section. The air inlet panel 114 can prevent external dust and other impurities from entering the air conditioner. The air inlet panel 114 can be connected with the face frame 111, and the air inlet panel 114 can also be connected with the reinforcing support 113. The reinforcing support has a hollow structure through which airflow can pass. The reinforcing support 113 is provided at the air inlet 111*a* and at an inner side of the air inlet panel 114 (the inner side of the air inlet panel 114 refers to a side of the air inlet panel 114 close to a center of the air conditioner, such as a rear side of the air inlet panel 114), and a supporting member is connected with the face frame 111. Thus, the reinforcing support 113 can improve the structure strength of the face frame to prevent the face frame 111 from deforming.

Optionally, the reinforcing support 113 and the face frame 111 can be formed integrally. Thus, the assembly process of the face frame 111 and the reinforcing support 113 can be simplified, and the overall structure strength of the face frame 111 can be improved.

Optionally, the air inlet panel 114 can be detachably provided at the air inlet 111*a*. For example, the air inlet panel 114 can be screwed to the face frame 111 or the reinforcing support 113, and the air inlet panel 114 can also be connected with the face frame 111 or the reinforcing support 113 by a snap. Thus, it is convenient to disassemble, assemble and maintain the air inlet panel 114, as well as other components in the air conditioner. For example, with the air inlet panel 114 being removed, other components in the air conditioner can be disassembled, assembled or maintained through the air inlet 111*a*.

In the panel assembly for the air conditioner according to the embodiments of the present disclosure, the air outlet 111*b* is arranged above the air inlet 111*a* and the air outlet surface of the air outlet 111*b* is configured to extend obliquely backward in the direction from bottom to top, hence the length of the air channel 12*a* can be reduced when the panel assembly is applied to the air conditioner, thereby shortening the length of the flow path in the air channel 12*a* and reducing the air flow loss, the air blowing distance can be increased, and moreover, the air outlet 111*b* can blow air obliquely upward to prevent the cold air from being directly blown towards persons. Meanwhile, the air output area can be enlarged, and the working performance of the air conditioner can be improved. In addition, with the air inlet panel 114 at the air inlet 111*a*, external dust and other impurities can be prevented from entering the air conditioner. Additionally, with the reinforcing support 113, the structure strength of the face frame 111 can be improved and the deformation of the face frame 111 can be prevented.

According to some embodiments of the present disclosure, referring to FIG. 4, an included angle between the air outlet surface and the vertical direction is denoted as $\alpha$ and $\alpha$ satisfies: $50° \leq \alpha \leq 66°$. Thus, with the included angle between the air outlet surface and the vertical direction being set within the above range, the air outlet surface can have a relatively large air output area, and while the flow path in the air conditioner is shortened, not only direct air blowing towards people can be avoided, but also the air outlet 111*b* can blow air obliquely forward at a suitable angle.

Figure 3:
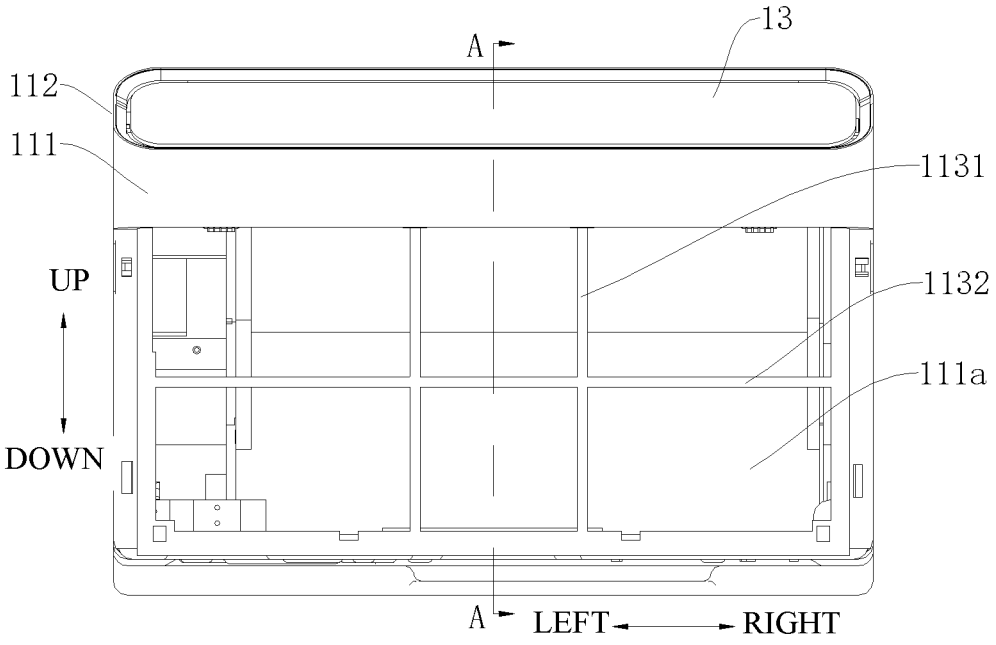
FIG. 3 is a front view of a partial structure of a window air conditioner according to an embodiment of the present disclosure.

According to some embodiments of the present disclosure, referring to FIG. 3, the reinforcing support 113 includes a plurality of first support rods 1131 spaced apart in a left-right direction and at least one second support rod 1132. Each of the first support rods 1131 extends along an up-down direction, and the second support rod 1132 extends along the left-right direction. The plurality of first support rods 1131 are each connected with the second support rod 1132. As a result, the reinforcing support 113 has a simple structure and high structure strength.

According to some optional embodiments of the present disclosure, referring to FIGS. 11-17, the air inlet panel 114 is detachably provided at the air inlet 111*a*. A plurality of first snaps 10 (for example, two) are provided at an upper end of the air inlet panel 114 and spaced apart along the left-right direction. The face frame 111 is provided with a plurality of second snaps 20 (for example, two) snapped with the first snaps 10 in one-to-one correspondence. The second snap 20 is supported on the first snap 10. A snapping portion 201 of the second snap 20 is located on a front side of a snapping portion 101 of the first snap 10 and abuts against the snapping portion 101. A plurality of third snaps 30 (for example, four) are provided at a lower end of the air inlet panel 114 and spaced apart along the left-right direction. The face frame 111 is provided with a plurality of fourth snaps 40 (for example, two) snapped with the third snaps 30 in one-to-one correspondence. The third snap 30 is supported on the fourth snap 40. A snapping portion 401 of the fourth snap 40 is located on a front side of a snapping portion 301 of the third snap 30 and abuts against the snapping portion 301.

Thus, since the second snap 20 is supported on the first snap 10 and the third snap 30 is supported on the fourth snap 40, position limiting of the air inlet panel 114 in the up-down direction can be realized; since the snapping portion 201 of the second snap 20 is located on the front side of and abuts against the snapping portion 101 of the first snap 10, and the snapping portion 401 of the fourth snap 40 is located on the front side of and abuts against the snapping portion 301 of the third snap 30, position limiting of the air inlet panel 114 in a front-rear direction can be realized. A left end a right end of the air inlet panel 114 abut against a left side wall and a right side wall of the air inlet 111*a* respectively, such that position limiting of the air inlet panel 114 in the left-right direction can be realized. Thus, the air inlet panel 114 can be mounted and positioned at the air inlet 111*a*, and the air inlet panel 111*a* can be mounted and disassembled conveniently.

Figure 14:
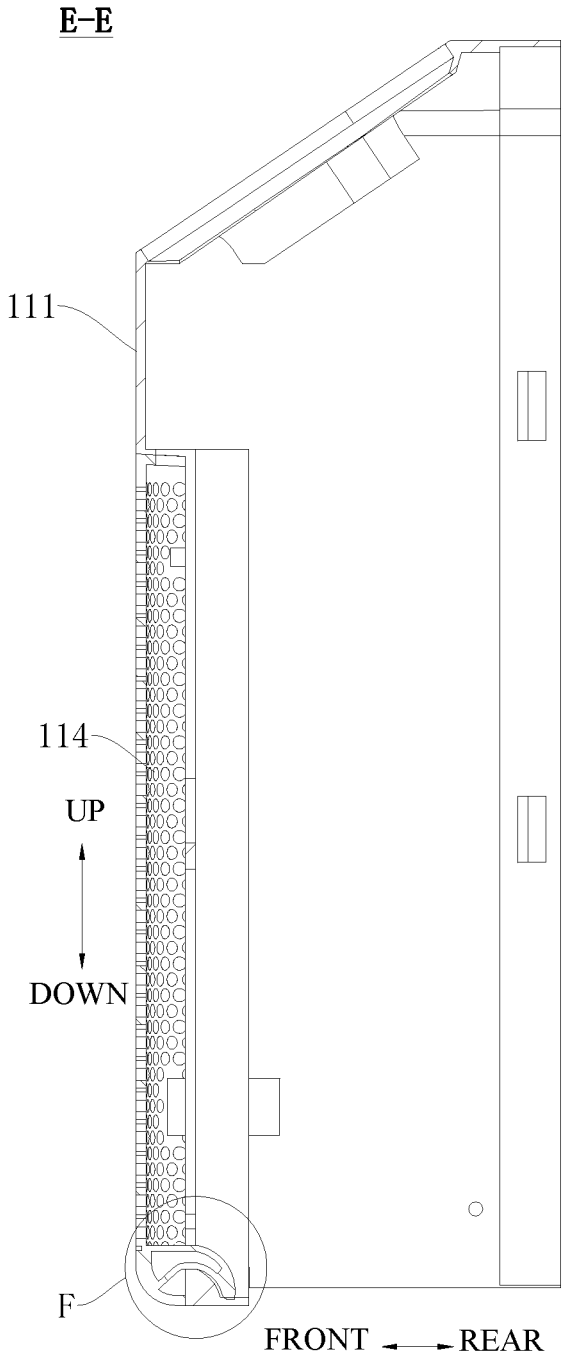
FIG. 14 is a sectional view along line E-E in FIG. 11.
Figure 15:
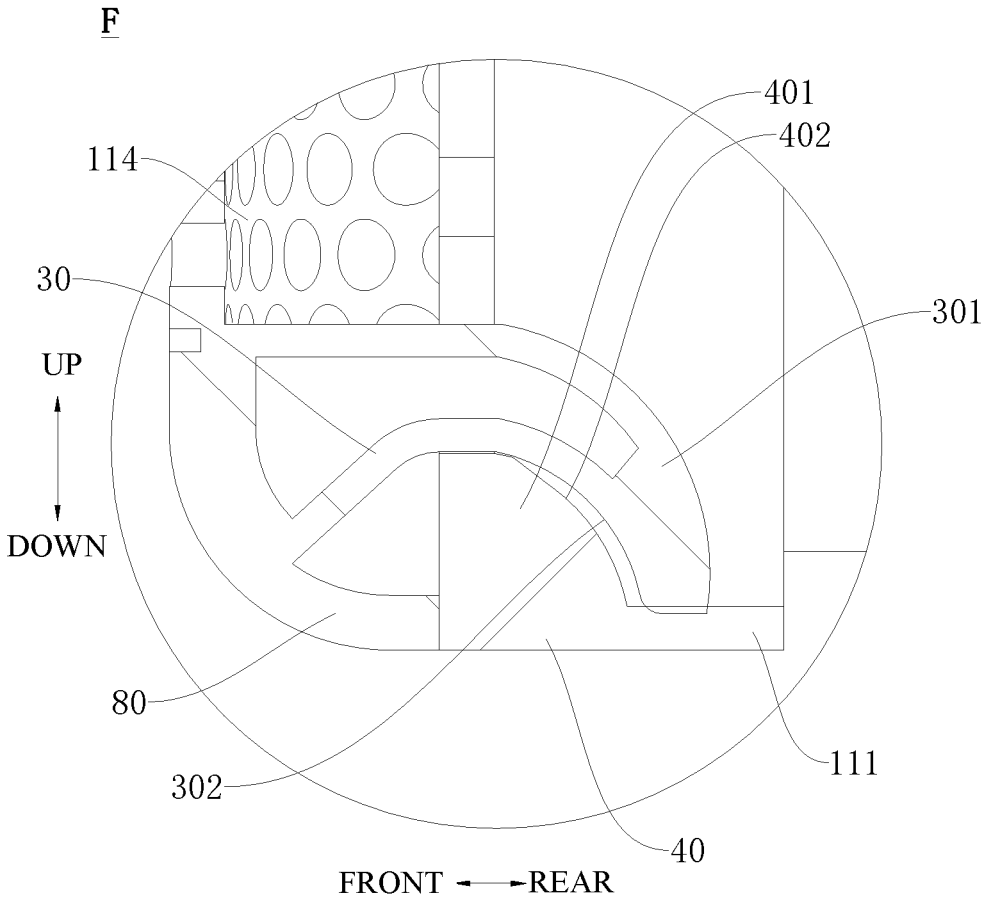
FIG. 15 is an enlarged view of part F in FIG. 14.
Figure 16:
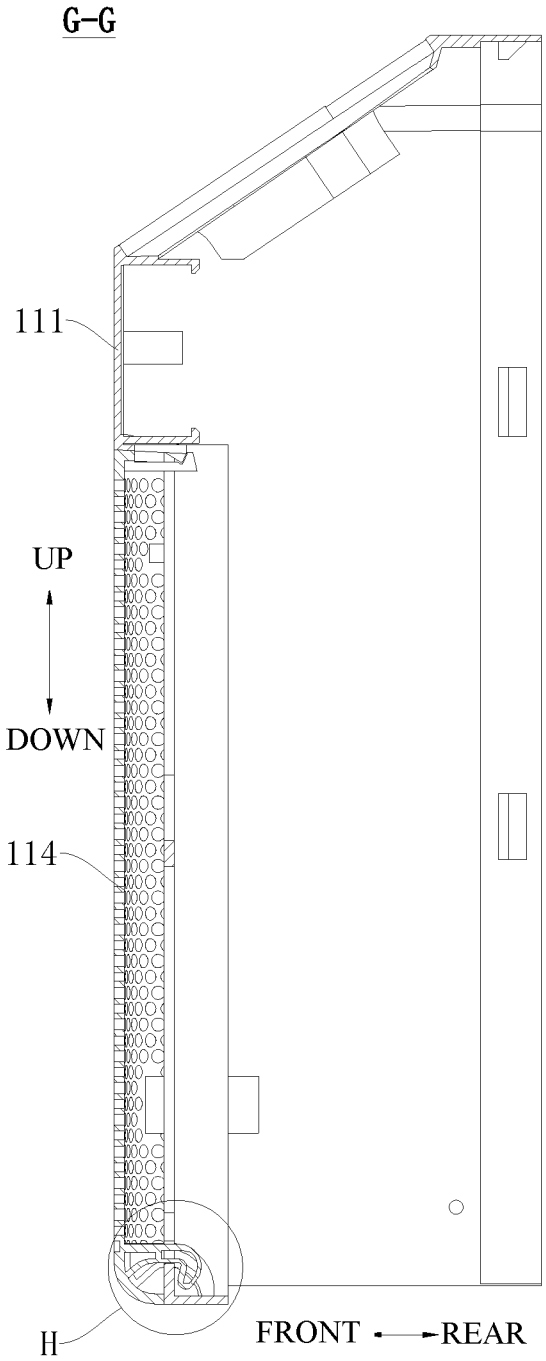
FIG. 16 is a sectional view along line G-G in FIG. 11.
Figure 17:
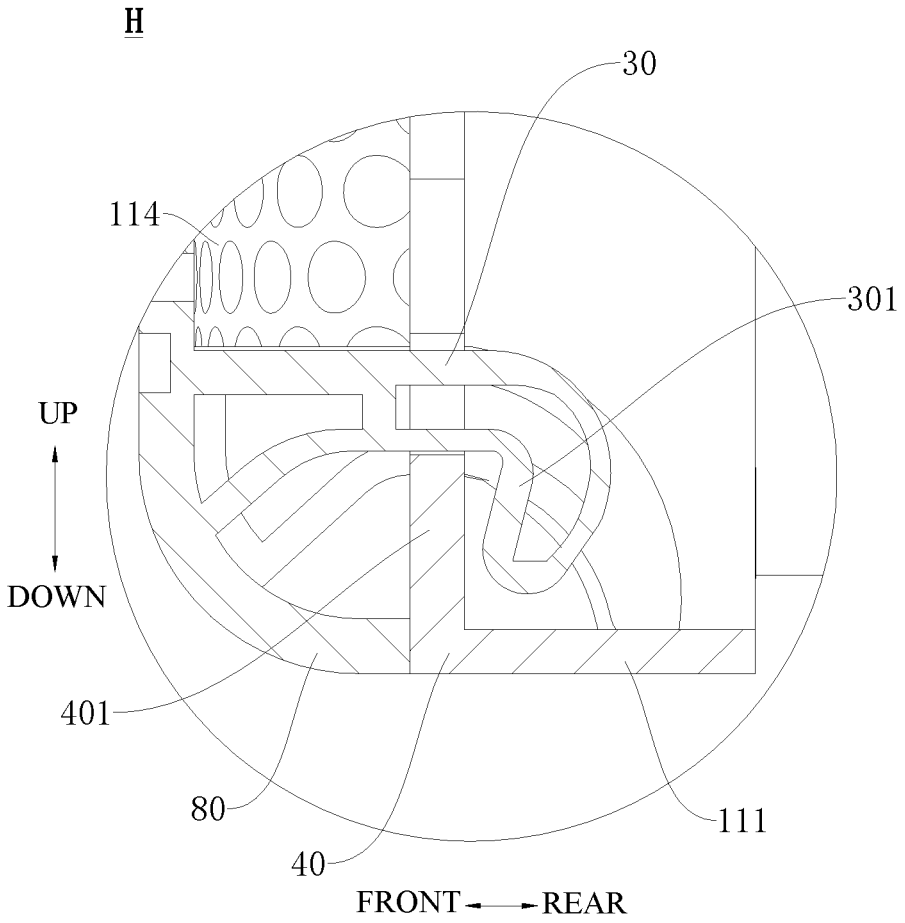
FIG. 17 is an enlarged view of part H in FIG. 16.
Figure 18:
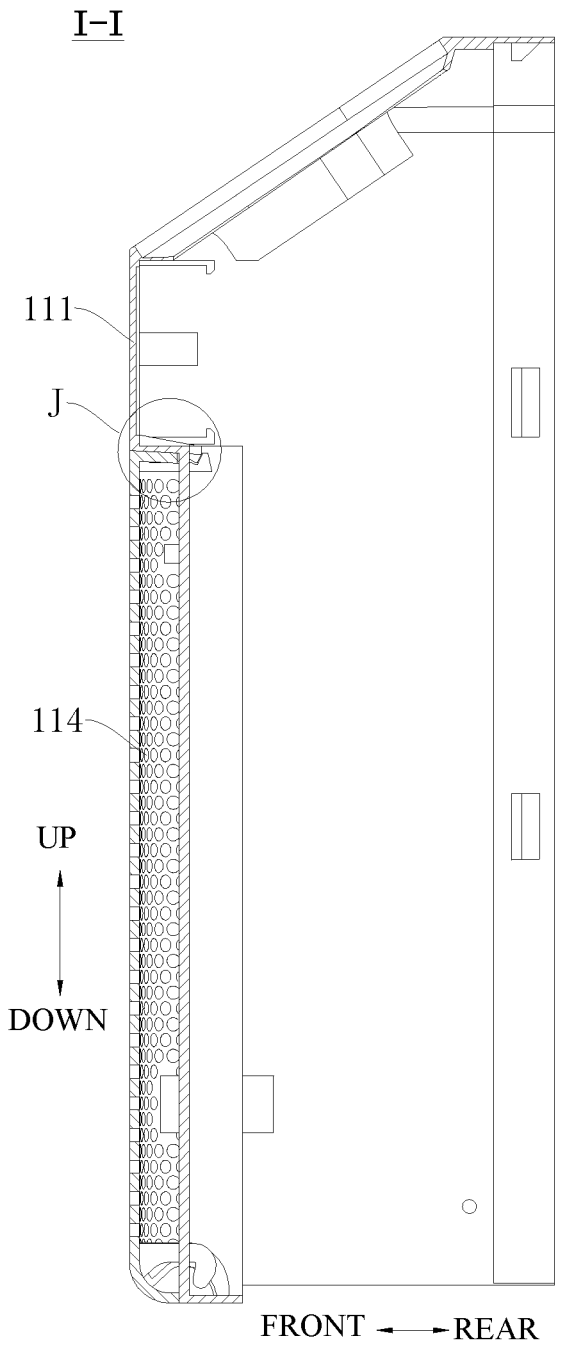
FIG. 18 is a sectional view along line I-I in FIG. 11.
Figure 19:
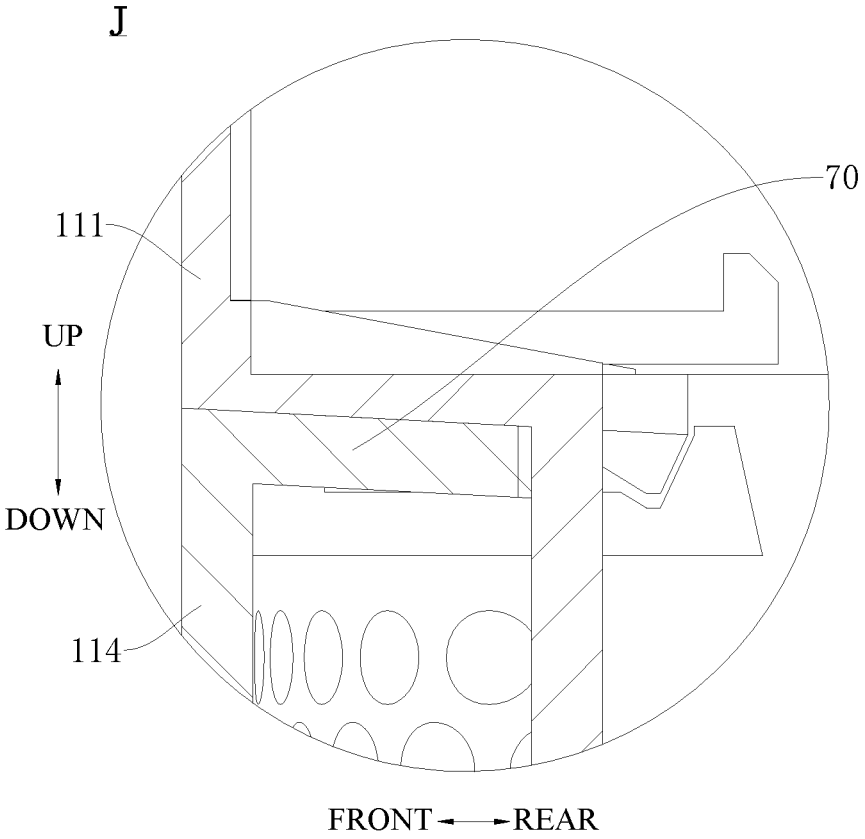
FIG. 19 is an enlarged view of part J in FIG. 18.
Figure 20:
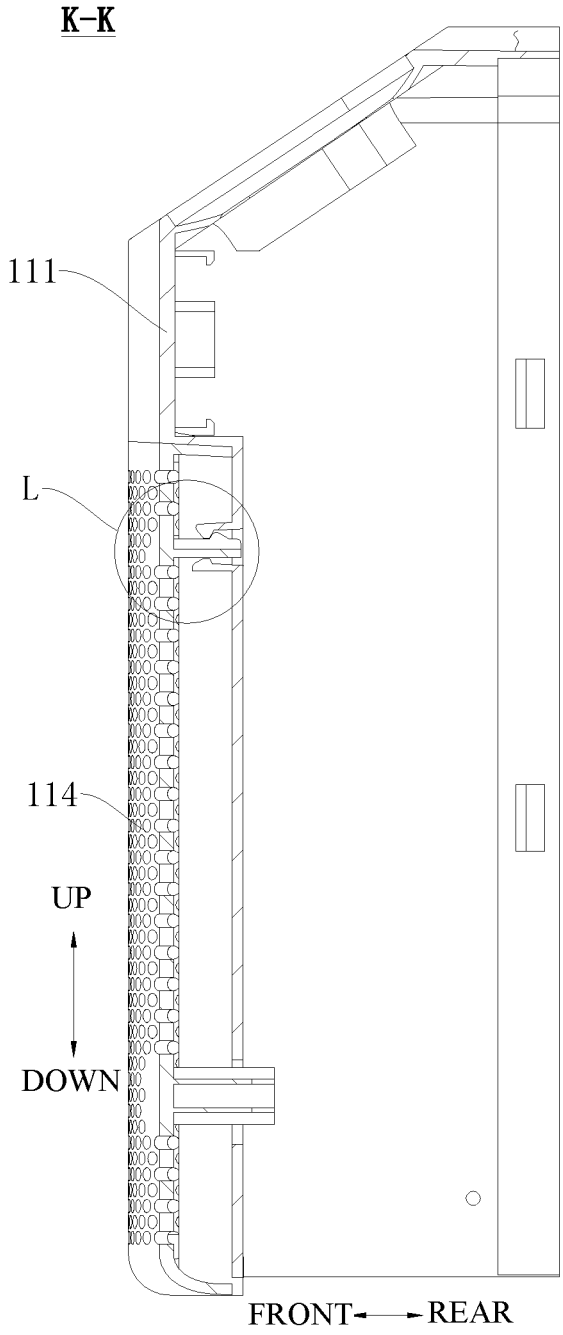
FIG. 20 is a sectional view along line K-K in FIG. 11.

Optionally, referring to FIG. 15 and in conjunction with FIG. 14, the snapping portion 301 of at least one third snap 30 has a first guide surface 302, and the snapping portion 401 of at least one fourth snap 40 has a second guide surface 402 cooperating with the first guide surface 302. Both of the first guide surface 302 and the second guide surface 402 are curved surfaces. For example, in the examples of FIGS. 11 and 14-17, four third snaps 30 and four fourth snap 40 are provided, the rightmost third snap 30 and the leftmost third snap 30 each have the first guide surface 302, and the corresponding two fourth snaps 40 each have the second guide surface 402. Thus, through the cooperation of the first guide surface 302 and the second guide surface 402, the disassembly and assembly of the air inlet panel 114 is easier and smoother. For example, during the disassembly of the air inlet panel 114, the first snap 10 can be separated from the second snap 20 and then the upper end of the air inlet panel 114 can be rotated forward. In the process of rotating the air inlet panel 114, due to the cooperation between the first guide surface 302 and the second guide surface 402, the rotation of the air inlet panel 114 is easier and smoother. When the air inlet panel 114 is rotated forward by a certain angle, the third snap 30 is separated from the fourth snap 40 so that the air inlet panel 114 can be easily and conveniently removed.

Optionally, referring to FIGS. 14-19, a top of the air inlet panel 114 is formed with a first flange part 70 extending backward, and the first flange part 70 is suitable to abut against a top wall of the air inlet 111*a*. Therefore, the position limitation on the air inlet panel 114 along the up-down direction can be further enhanced, and a contact area between the air inlet panel 114 and the face frame 111 can be increased as well, thereby improving the installation reliability of the air inlet panel 114. A bottom of the air inlet panel 114 is formed with a second flange part 80 extending backward, and the second flange part 80 abuts against a front wall of the face frame 111. Therefore, the position limitation on the air inlet panel 114 along the front-rear direction can be further enhanced, so that the installation of the air inlet panel 114 is more reliable.

Optionally, referring to FIGS. 20-23, the air inlet panel 114 is formed with a plurality of positioning columns 50 (for example, four), and the plurality of positioning columns 50 are distributed at left and right ends of the air inlet panel 114. The face frame 111 is formed with a plurality of positioning holes 60 (for example, four) fitted with the plurality of positioning columns 501 in one-to-one correspondence. Therefore, due to the fitting between the positioning columns 50 and the positioning holes 60, in combination with the aforementioned snap fitting, the installation reliability of the air inlet panel 114 can be further improved.

Figure 21:
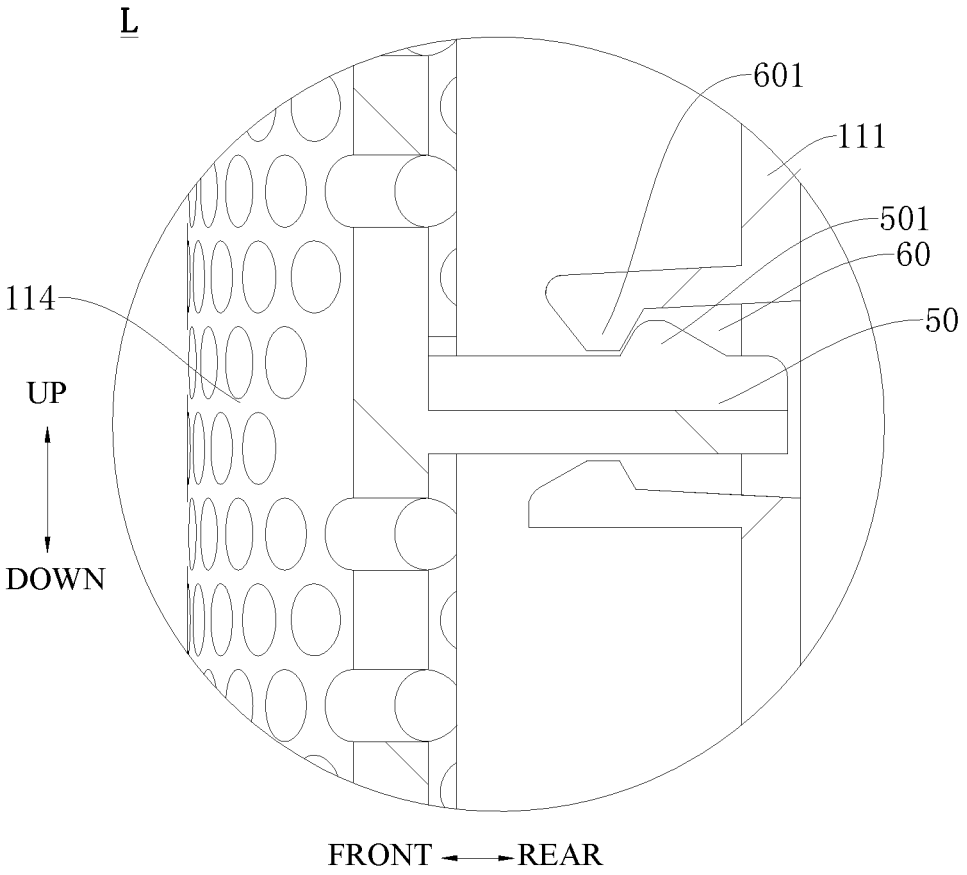
FIG. 21 is an enlarged view of part L in FIG. 20.
Figure 22:
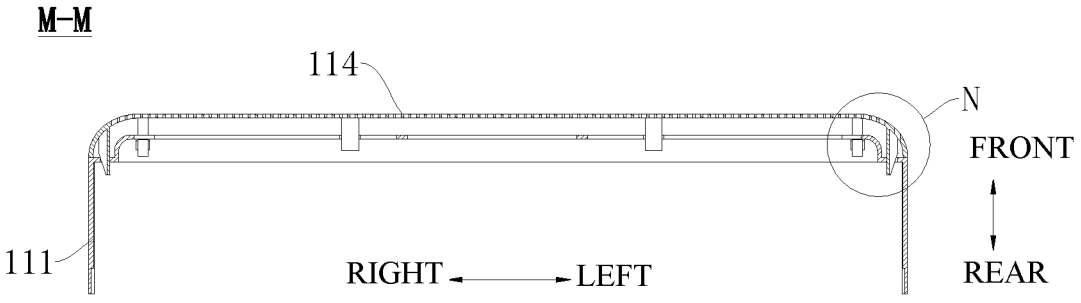
FIG. 22 is a sectional view along line M-M in FIG. 11.
Figure 23:
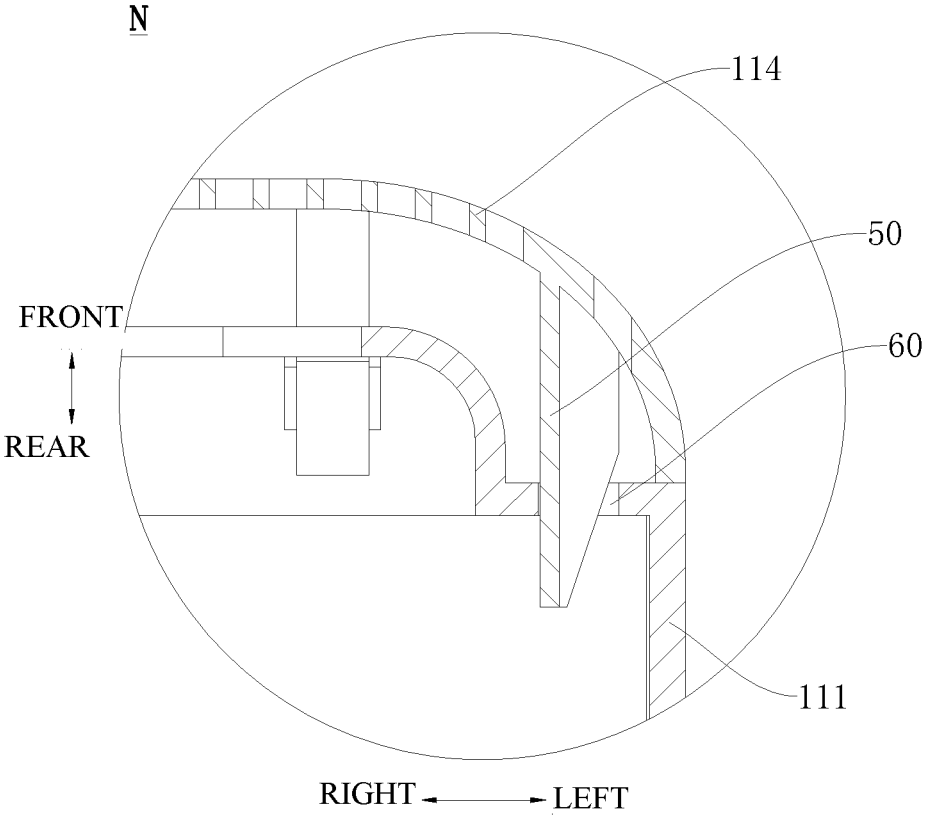
FIG. 23 is an enlarged view of part N in FIG. 22.

Furthermore, referring to FIG. 21, an outer peripheral wall of at least one of the positioning columns is formed with a first limiting protrusion 501, and an inner peripheral wall of at least one of the positioning holes 60 is formed with a second limiting protrusion 601 cooperating with the first limiting protrusion 501. The second limiting protrusion 601 is located on a front side of the first limiting protrusion 501 and abuts against the first limiting protrusion 501. Thus, the cooperation reliability of the positioning column 50 and the positioning hole 60 can be further improved, thereby further enhancing the installation reliability of the air inlet panel 114.

For example, in the examples of FIG. 11 and FIGS. 20-23, the air inlet panel 114 is formed with four positioning columns 50, two of the four positioning columns 50 are located at the left end of the air inlet panel 114 and spaced apart along the up-down direction, and the other two positioning columns 50 are located at the right end of the air inlet panel 114 and spaced apart along the up-down direction. The face frame 111 is formed with four positioning holes 60 in corresponding positions. An upper positioning column 50 of the positioning columns 50 at the left end has an outer peripheral wall formed with the above-mentioned first limiting protrusion 501, and an upper positioning column 50 of the positioning columns 50 at the right end has an outer peripheral wall formed with the above-mentioned first limiting protrusion 501. Correspondingly, the respective inner peripheral walls of the two corresponding positioning holes 60 are each formed with the above-mentioned second limiting protrusion 601. Thus, the disassembly and assembly of the air inlet panel 114 can be convenient, and the air inlet panel 114 can be installed firmly.

As shown in FIGS. 1-6, a window air conditioner 100 according to embodiments of a second aspect of the present disclosure includes an indoor part 1 and an outdoor part 2. The outdoor part is connected with the indoor part 1. The indoor part 1 includes: an indoor housing 11, a volute 12, an indoor heat exchanger 15, and a fan wheel 14. The indoor housing 11 includes the panel assembly according to the embodiments of the first aspect of the present disclosure, and a rear case 112. The rear case 112 is located at a rear side of the face frame 111 and is connected with the face frame 111. The volute 12 is provided in the indoor housing 11. The volute 12 can include a first volute 121 and a second volute 122 arranged along the front-rear direction. The volute 12 defines an air channel 12*a* in communication with both of the air inlet 111*a* and the air outlet 111*b*. The air channel 12*a* extends to the air outlet 111*b*, and the fan wheel 14 is provided in the air channel 12*a*. The indoor heat exchanger 15 is provided in the indoor housing 11, and the indoor heat exchanger 15 and the air inlet 111*a* are arranged opposite to each other.

When the window air conditioner 100 works, the fan wheel 14 operates to drive airflow to enter the air channel 12*a* from the air inlet 111*a* and flow along the air duct 12*a*. After exchanging heat with the indoor heat exchanger 15 in the air channel 12*a*, the airflow flows out to the indoor through the air outlet 111*b*, thereby adjusting the indoor temperature.

For the window air conditioner 100 according to the embodiments of the present disclosure, with the above panel assembly, the air blowing distance and the air output area of the air conditioner can be increased, and the deformation of the air inlet panel 114 at the inlet 111*a* can be prevented.

According to some embodiments of the present disclosure, referring to FIGS. 1, and 3-4, the window air conditioner 100 includes an air guide plate 13 configured to open and close the air outlet 111*b*. The air guide plate 13 is provided in the air channel 12*a* and is rotatably connected with the volute 12. Thus, the opening and closing of the air outlet 111*b* can be easily achieved by arranging the air guide plate 13 at the air outlet 111*b*, and by controlling a rotation angle of the air guide plate 13, the air blowing direction can also be adjusted, and for example, the air output in the up-down direction can be adjusted.

According to some embodiments of this disclosure, referring to FIGS. 4 and 24-26, the window air conditioner 100 includes: an air guide assembly, and the air guide assembly is arranged in the air channel 12*a* and downstream of the fan wheel 14. The air guide assembly includes a plurality of louvers 171 spaced apart along the left-right direction, and each louver 171 is rotatably connected with the volute 12. Thus, with the aforementioned air guide assembly being provided in the air channel 12*a*, an air guiding function in the left-right direction can be achieved. For example, the window air conditioner 100 can blow air towards a left front side or towards a right front side, or towards a front side. Moreover, because the air guide assembly is arranged in the air channel 12*a* defined by the volute 12 and is connected with the volute 12, the internal structure of the air channel can be simplified. The airflow flows along the air channel 12*a* defined by the volute 12, and is blown out to the indoor through the air outlet 1116 after being guided by the air guide assembly in the air channel 12*a*. During the process of the airflow flowing along the air channel 12*a* to the air outlet 111*b*, the airflow always flows in the volute 12. The loss caused by the air flowing along different components can be avoided, thus reducing the air flow loss.

In addition, with the air guide assembly, the air guide plane 13 and the like in the volute 12, the installation of the air guide structures of the whole machine is modularized, and the assembly of the whole machine is also facilitated. For example, after the air guide structures such as the air guide assembly and the air guide plane 13 are installed into the volute 12, the air channel 12*a* can be integrally installed into a housing of the whole machine.

Figure 24:
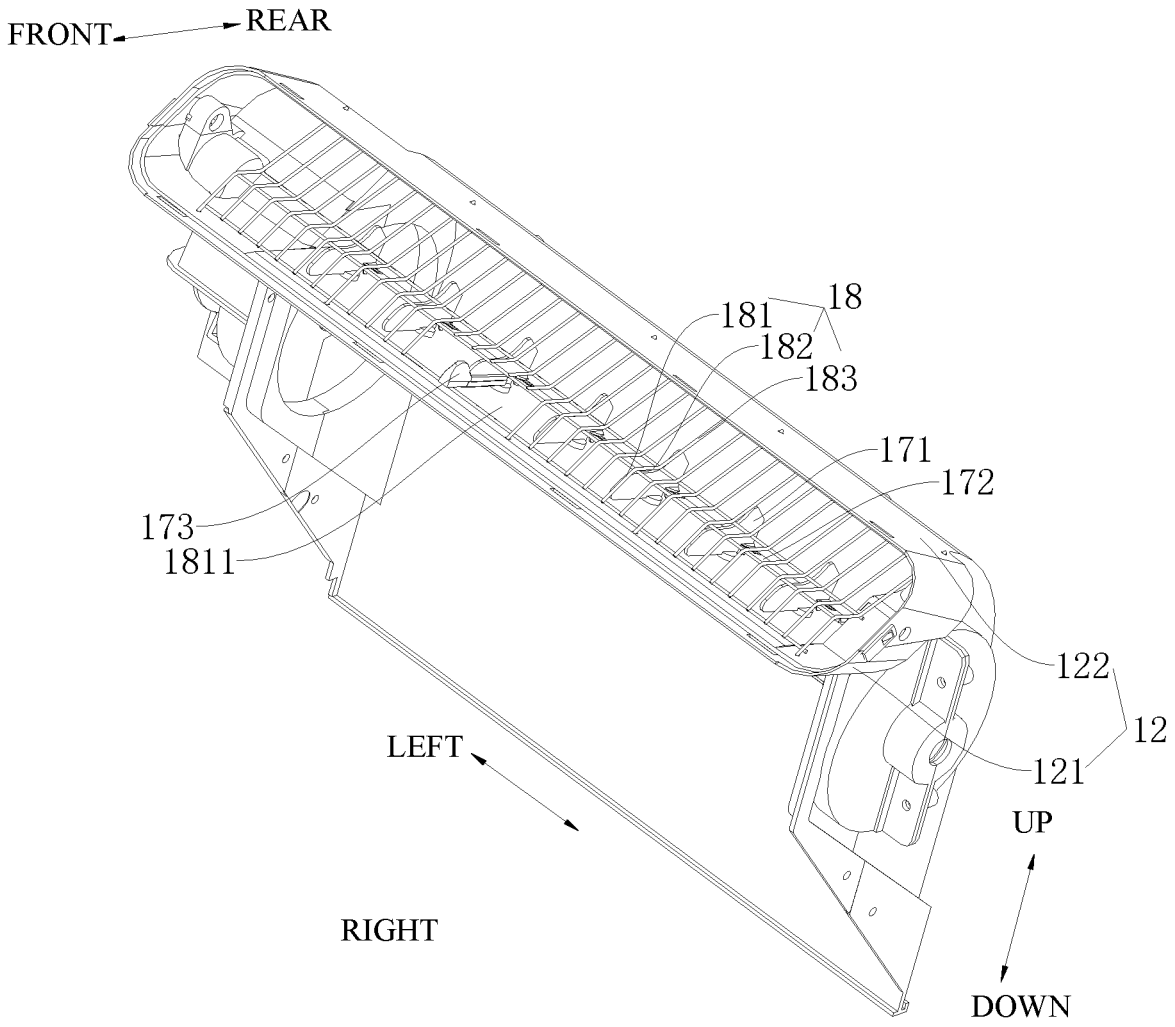
FIG. 24 is a perspective view of a partial structure of a window air conditioner according to an embodiment of the present disclosure.
Figure 25:
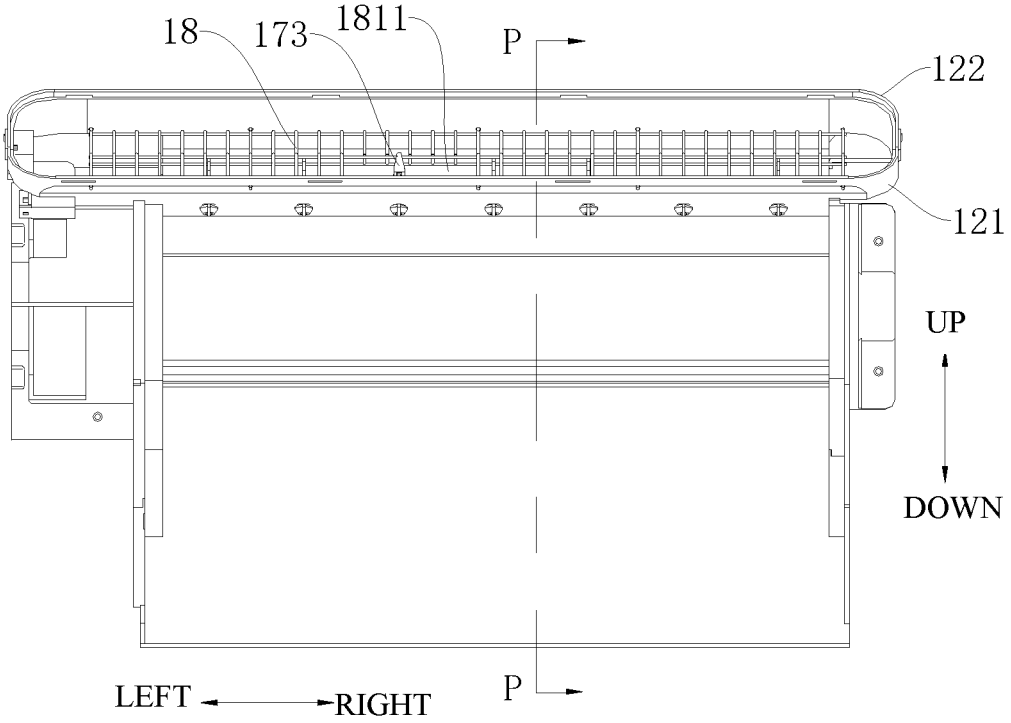
FIG. 25 is a front view of a partial structure of a window air conditioner according to an embodiment of the present disclosure.

For example, in one embodiment of the present disclosure, referring to FIGS. 24 and 25, the air guide assembly includes a plurality of louvers 171 spaced apart in the left-right direction and a connecting rod 172. Each louver 171 is rotatably connected with volute 12, and the connecting rod 172 extends along the left-right direction and is movable along the left-right direction. Each louver 171 is rotatably connected with the connecting rod 172. When the connecting rod 172 moves, the plurality of louvers 171 are driven to swing in the left-right direction, so as to achieve the air guiding effect along the left-right direction. At the same time, the window air conditioner 100 also includes the air guide plate 13, and can adjust the air output in the up-down direction by controlling the rotation angle of the air guide plate 13. Thus, with the air guide plate 13 and the air guide assembly including the plurality of louvers 171, the air guidance of the window air conditioner 100 in the left-right direction and the up-down direction can be achieved, and an air guiding range of the window air conditioner 100 can be expanded.

Further, referring to FIGS. 24 and 25, the air guide assembly can also include a shifting block 173. The shifting block 173 is provided in the air channel 12*a* and is swingable in the left-right direction, and the shifting block 173 is connected with the connecting rod 172 or any one of the louvers 171. For example, the shifting block 173 can be connected with the connecting rod 172. When the shifting block 173 is shifted leftwards or rightwards, the connecting rod 172 can be pushed to move leftwards or rightwards, such that the plurality of louvers 171 are driven to turn leftwards or rightwards, and then the air blowing direction can be adjusted. The shifting block 173 can also be connected with any one of the plurality of louvers 171. When the shifting block 173 is shifted leftwards or rightwards, the corresponding louver 171 can be driven to turn, and the connecting rod 172 can be driven to move leftwards or rightwards, in order to drive other louvers 171 to turn leftwards or rightwards, thereby adjusting the air blowing direction. Thus, with the shifting block 173, the plurality of louvers 171 can turn easily without energy consumption, which reduces the energy consumption of the whole machine, eliminates a component for driving the louvers 171 to turn, and simplifies the structure of the whole machine.

Figure 26:
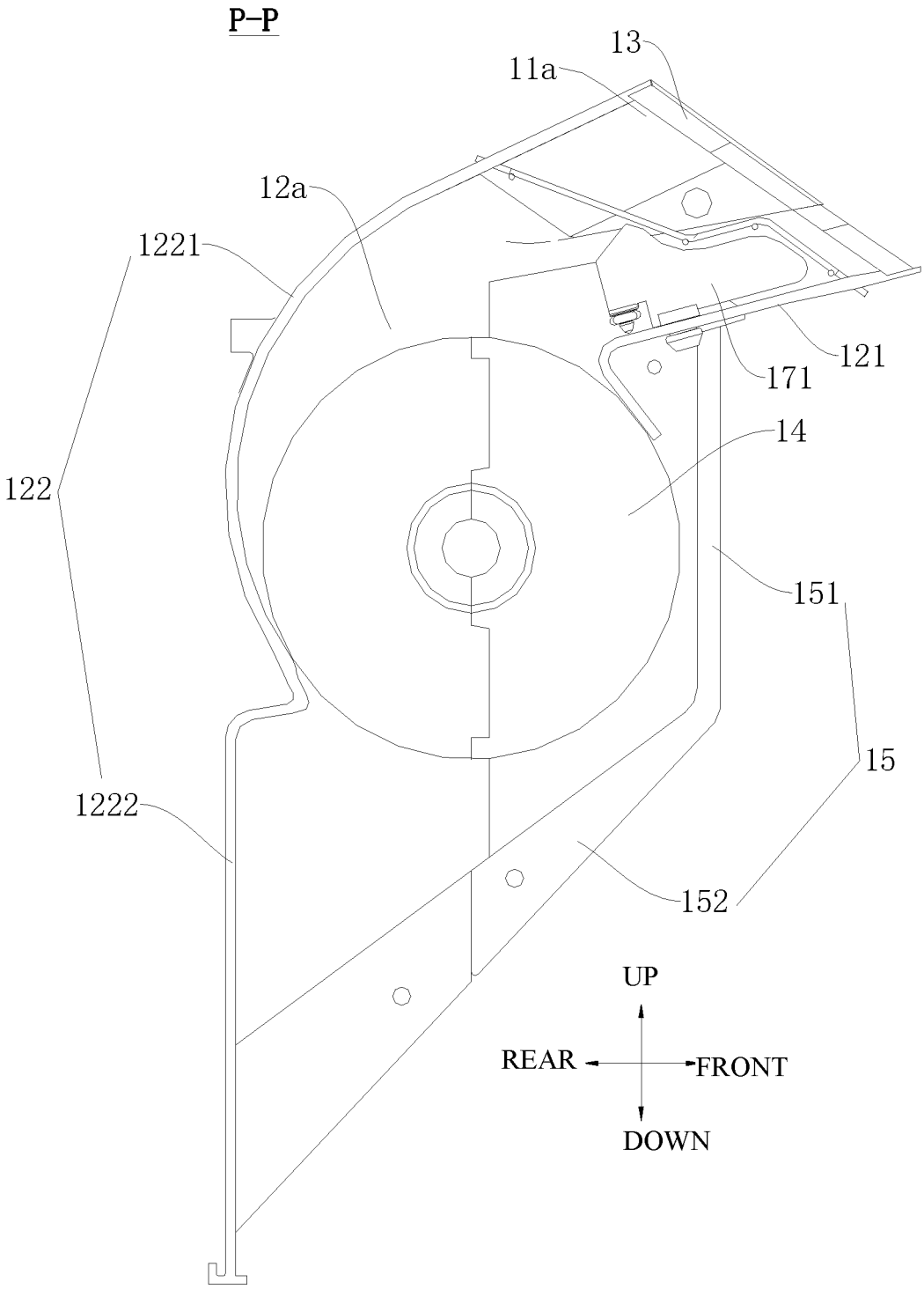
FIG. 26 is a sectional view along line P-P in FIG. 25.

According to some embodiments of the present disclosure, referring to FIGS. 24-26, the window air conditioner 100 includes the air guide assembly and a protecting mesh 18. The air guide assembly is provided in the air channel 12 and located downstream of the fan wheel 14. When the fan wheel 14 operates, the fan wheel 14 drives airflow to flow along the air channel 12*a* towards an air outlet end 11*a* of the air channel 12*a*. The protecting mesh 18 is provided in the air channel 12*a* and located downstream of the air guide assembly. At least a part of the protecting mesh 18 is recessed inwardly (the inward direction refers to a direction facing the air channel 12*a*). It is possible that only a part of the protecting mesh 18 is recessed inwardly, and it is also possible that the whole protecting mesh 18 is recessed inwardly. As a result, with the protecting mesh 18, it is possible to prevent hands from extending into the air channel 12*a*, thereby avoiding danger and improving safety.

Moreover, with the protecting mesh 18 being provided downstream of the air guide assembly, the protecting mesh 18 can disperse the airflow at the air outlet end 11*a* to some extent, and the air blowing at the air outlet end 11*a* is more uniform and gentle. In addition, with at least a part of the protecting mesh 18 being recessed inward, a space for accommodating other air guiding structures can be reserved at the air outlet end 11*a*. For example, when the air guide plate 13 is provided at the air outlet end 11*a*, with at least a part of the protecting mesh 18 being recessed inward, a space for accommodating the air guide plate 13 and for its movement can be reserved, so as to prevent interference with the protecting mesh 18 when the air guide plate 13 turns. Meanwhile, the structure of the air channel assembly is compact.

In other embodiments, the protecting mesh 18 can also be arranged upstream of the air guide assembly, so that the air guide assembly is closer to the air outlet 111*b* and the air guiding effect is better.

Optionally, the protecting mesh 18 can be a metal mesh, and for example, the protecting mesh 18 can be an iron wire mesh.

Optionally, referring to FIGS. 24 and 26, the protecting mesh 18 includes: a first mesh section 181, a second mesh section 182, and a third mesh section 183. The first mesh section 181 is parallel to the air outlet surface, and the air outlet surface is a plane where an end surface of the air outlet end 11*a* is located. The first mesh section 181 is connected with an inner wall of the volute 12. The second mesh section 182 is located upstream of the first mesh section 181. A first end of the second mesh section 182 is connected with the first mesh section 181, and a second end of the second mesh section 182 extends inward (the inward direction refers to the direction facing the air channel 12*a*). The second mesh section 182 and the first mesh section 181 are at an angle to each other. The third mesh section 183 is located upstream of the second mesh section 182, and the third mesh section 183 and the first mesh section 181 are located on both sides of the second mesh section 182. The second end of the second mesh section 182 is connected with the third mesh section 183. The third mesh section 183 and the second mesh section 182 are at an angle to each other. The third mesh section 183 is connected with the inner wall of the volute 12. Thus, with the third mesh section 183 being recessed inward, a clearance space is defined among the second mesh section 182, the third mesh section 183, and the inner walls of volute 12, and the clearance space can be used for rotation of the air guide plate 13. In addition, the protecting mesh 18 has a generally z-shaped cross section, such that the protecting mesh 18 has high structure strength.

Further, referring to FIGS. 24 and 26, the third mesh section 183 extends obliquely inward in a direction from the second mesh section 182 to the third mesh section 183 (the inward direction refers to the direction facing the air channel 12*a*). Therefore, a larger clearance space is reserved to ensure that the air blowing structure (such as the air guide plate 13) installed at the air outlet end 11*a* has a sufficient movement space.

According to some embodiments of the present disclosure, referring to FIGS. 24-26, the air guide assembly includes: a plurality of louvers spaced apart along the left-right direction, a connecting rod, and a shifting block 173. Each louver is rotatably connected with the volute 12. The connecting rod extends along the left-right direction and is movable along the left-right direction. Each louver is rotatably connected with the connecting rod. The plurality of louvers can be driven to swing in the left-right direction when the connecting rod moves, so as to achieve the air guiding effect in the left-right direction. The shifting block 173 is provided in the air channel 12*a* and is swingable in the left-right direction. The shifting block 173 is connected with the connecting rod 172, or the shifting block 173 is connected with any one of the louvers 171. For example, the shifting block 173 can be connected with the connecting rod 172. When the shifting block 173 is shifted leftwards or rightwards, the connecting rod 172 can be pushed to move leftwards or rightwards, such that the plurality of louvers 171 are driven to turn leftwards or rightwards, and then the air blowing direction can be adjusted. The shifting block 173 can also be connected with any one of the plurality of louvers 171. When the shifting block 173 is shifted leftwards or rightwards, the corresponding louver 171 can be driven to turn, and the connecting rod 172 can be driven to move leftwards or rightwards, in order to drive other louvers 171 to turn leftwards or rightwards, thereby adjusting the air blowing direction. Thus, with the shifting block 173, the plurality of louvers 171 can turn easily without energy consumption, which reduces the energy consumption of the whole machine, eliminates a components for driving the louvers 171 to turn, and simplifies the structure of the whole machine. Meanwhile, the protecting mesh 18 is provided with an operation opening 1811 corresponding to the shifting block 173. For example, the operation opening 1811 can be formed in the above-mentioned first mesh section 181. Thus, with the shifting block 173 being operated in the operation opening 1811, it is convenient to operate the shifting block 173.

According to some embodiments of the present disclosure, referring to FIGS. 4 and 24-26, the volute 12 includes a first volute 121 and a second volute 122 cooperating with each other. The first volute 121 and the second volute 122 define the air channel 12*a* therebetween, and both the first volute 121 and the second volute 122 are independently molded parts. Thus, with the volute 12 being configured as the first volute 121 and the second volute 122 which are molded independently, the installation of the air channel assembly is facilitated. For example, the installation of the air guide assembly, the air guide plate 13 and the fan wheel 14 can be more convenient.

According to some embodiments of the present disclosure, referring to FIGS. 4 and 24-26, the volute 12 includes a first volute 121 and a second volute 122 cooperating with each other. The second volute 122 is located at a rear side of the first volute 121. The first volute 121 and the second volute 122 define the air channel 12*a* therebetween. The air channel assembly includes a fan wheel 14, and the fan wheel 14 is provided in the air channel 12*a* and located upstream of the air guide assembly. The second volute 22 includes a first volute section 1221 and a second volute section 1222 connected in the up-down direction. The first volute section 1221 is opposite to the first volute 121 and the fan wheel 14. The second volute section 1222 is constituted by a part of the second volute 122 below the fan wheel 14. The second volute section 1222 extends straightly. For example, the second volute section 1222 can extend vertically, and the second volute section 1222 can also have a small angle relative to the vertical direction. Thus, with the second volute section 1222 being configured to extend straightly, the air flow can be smoother, the noise generated by the air flow along the second volute section 1222 can be reduced, and the structure of the volute 12 is simple and easy to manufacture.

It should be noted that the terms "upstream" and "downstream" described in this disclosure is with respect to the air flow direction.

According to some embodiments of the present disclosure, referring to FIGS. 4 and 24-27, the indoor heat exchanger 15 includes a first heat exchange section 151 and a second heat exchange section 152 connected with each other. There is an angle between the first heat exchange section 151 and the second heat exchange section 152. For example, the angle between the first heat exchange section 151 and the second heat exchange section 152 can be an obtuse angle. The first heat exchange section 151 extends vertically, and the second heat exchange section 152 extends obliquely backward in the direction from top to bottom. Thus, with the indoor heat exchanger 15 being configured to include the first heat exchange section 151 and the second heat exchange section 152 that are at an angle to each other, a heat exchange area of the indoor heat exchanger 15 can be expanded and a heat exchange effect can be improved. The window air conditioner 100 also includes a filter screen 19, and the filter screen 19 is located on a side of the indoor heat exchanger 15 adjacent to the air inlet 111*a*. The air entering from the air inlet 111*a* can be filtered through the filter screen 19. The filter screen 19 includes a first filter section 191 and a second filter section 192 connected with each other. The first filter section 191 is opposite to and spaced apart from the first heat exchange section 151, and the second filter section 192 is opposite to and spaced apart from the second heat exchange section 152. Thus, there is a space for air flowing between the indoor heat exchanger 15 and the filter screen 19, to enable the airflow to exchange heat with the indoor heat exchanger 15 sufficiently.

Figure 27:
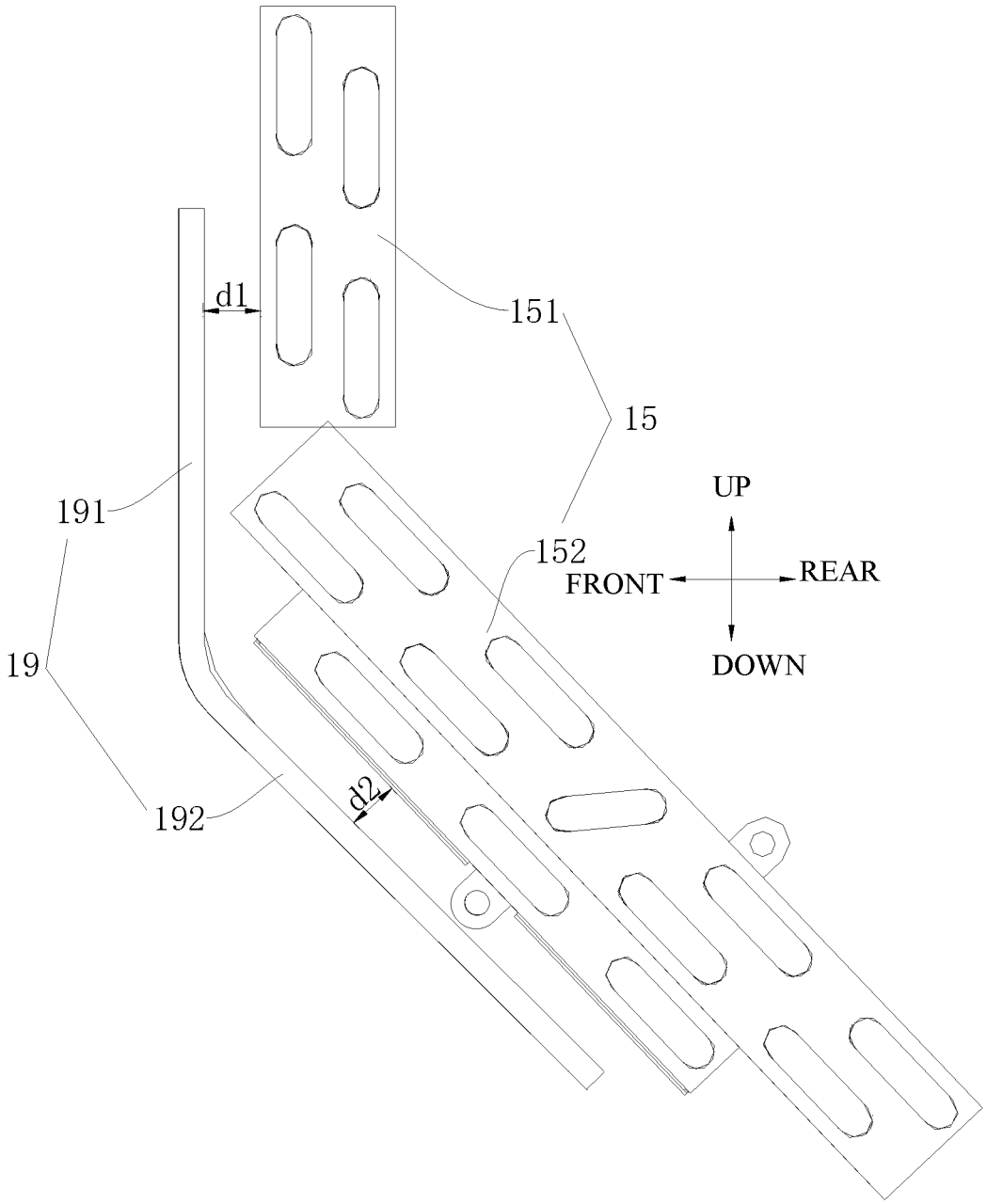
FIG. 27 is a schematic diagram illustrating that an indoor heat exchanger and a filter screen of a window air conditioner cooperate with each other according to an embodiment of the present disclosure.

Optionally, referring to FIG. 27, an angle between the first filter section 191 and the second filter section 192 is equal to the angle between the first heat exchange section 151 and the second heat exchange section 152. For example, the angle between the first heat exchange section 151 and the second heat exchange section 152, and the angle between the first filter section 191 and the second filter section 192 are both obtuse angles. The first heat exchange section 151 and the first filter section 191 extend vertically, while the second heat exchange section 152 and the second filter section 192 extend obliquely backward in the direction from top to bottom. As a result, the filter screen 19 and the indoor heat exchanger 15 have the same bending angle, and therefore the structure of the whole machine becomes compact.

Optionally, referring to FIG. 27, a distance between the first filter section 191 and the first heat exchange section 151 is d1, a distance between the second filter section 192 and the second heat exchange section 152 is d2, and d1 and d2 satisfy: $0.9 \leq d1/d2 \leq 1.2$. Thus, the distance between the filter screen 19 and the indoor heat exchanger 15 can be relatively uniform. When the airflow flows between the filter screen 19 and the indoor heat exchanger 15, the eddy current can be reduced and the noise can be decreased.

According to some embodiments of the present disclosure, referring to FIGS. 1 and 3-6, the window air conditioner 100 is supported in a window opening of a wall, and a movable window is provided in the window opening. The window air conditioner 100 includes a chassis 3, an indoor part 1 and an outdoor part 2, and the indoor part 1 and the outdoor part 2 are both arranged on the chassis 3. A receiving groove s is defined among the indoor part 1, the outdoor part 2 and the chassis 3. At least a part of the window can extend into the receiving groove s. For example, only a part of the window extends into the receiving groove s, or the whole window can be arranged in the receiving groove s. This not only facilitates the installation of the window air conditioner 100 into the window opening, thereby improving the installation reliability and stability of the window air conditioner 100, and also facilitates the cooperation between the window air conditioner 100 and the window, making the appearance of the window air conditioner 100 more aesthetic after installation.

According to some embodiments of the present disclosure, referring to FIGS. 1 and 5-7, the window air conditioner 100 includes a sealing assembly 16, and the sealing assembly 16 contacts the window and an inner wall of the window opening separately. The sealing assembly 16 includes a first connecting member 161 of a variable length, and a plurality of second connecting members 162. The first connecting member 161 includes a fixing member 1611 and a slide block 1612. At least a part of the fixing member 1611 is arranged in the receiving groove s. It is possible that only a part of the fixing member 1611 is arranged in the receiving groove s, or the whole fixing member 1611 is arranged in the receiving groove s. The slide block 1612 slidably cooperates with the fixing member 1612. Any one of the second connecting members 162 can be detachably connected with the slide block 1612, and any two of the second connecting members 162 can be detachably connected with each other.

Since the sealing assembly 16 includes the first connecting member 161, and the first connecting member 161 includes the fixing member 1611 and the slide block 1612, the sealing assembly 16 can be installed to the window air conditioner 100 by using the fixing member 1611, thereby facilitating the arrangement of the sealing assembly 16 and avoiding the loss of the sealing assembly 16; furthermore, through the sliding cooperation between the slide block 1612 and the fixing member 1611, the length of the first connecting member 161 can be adjusted, so the length of the sealing assembly 16 can adjusted, which allows the sealing assembly 16 to seal windows of various sizes, improves a sealing effect of the sealing assembly 16, and expands the application range of the sealing assembly 16. Hence, the application scope of the window air conditioner 100 can be broadened, and the functionality and applicability of the window air conditioner 100 can be improved.

In addition, with the plurality of second connecting members 162, any one of the second connecting members 162 can be detachably connected with slide block 1612, and any two of the second connecting members 162 can be detachably connected to each other to adjust the length of sealing assembly 16. The structural flexibility of the sealing assembly 16 can be improved. The length of the sealing assembly 16 can be adjusted by connecting different numbers of the second connecting members 162, so as to extend a variation range of the sealing length of the sealing assembly 16 and allow the sealing assembly 16 to adapt to various sizes of windows, thereby further improving the sealing reliability and stability of the sealing assembly 16, and further expanding the application range of the sealing assembly 16.

Figure 7:
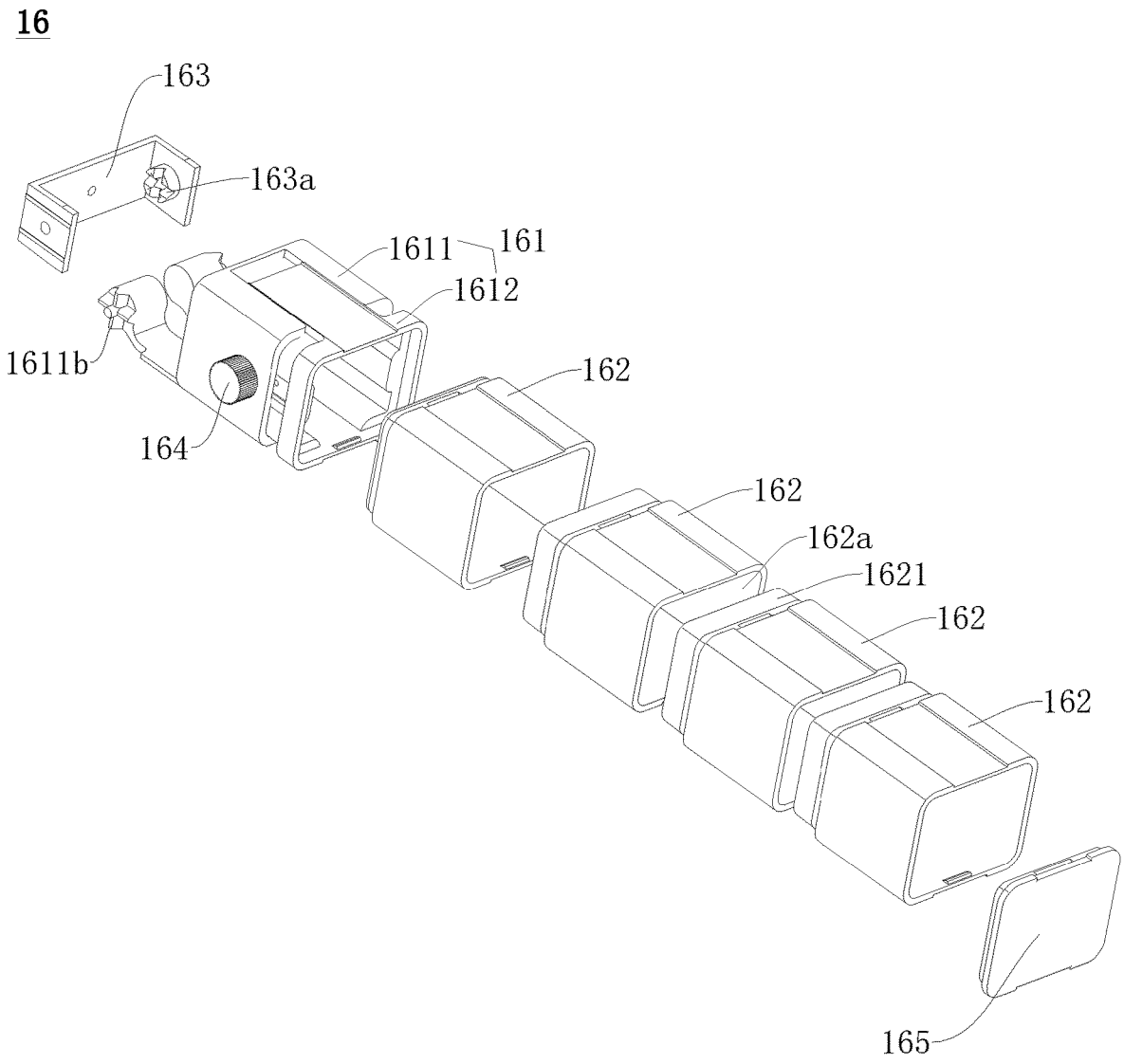
FIG. 7 is an exploded view of a sealing assembly of a window air conditioner according to an embodiment of the present disclosure.

For example, in an embodiment of the present disclosure, referring to FIG. 7, each second connecting member 162 includes an insertion part 1621, and each second connecting member 162 and the slide block 1612 both have an insertion chamber 162*a*. The insertion part 1621 of each second connecting member 162 can be fitted in the insertion chamber 162*a* of the adjacent second connecting member 162 in a pluggable manner. Thus, the adjacent second connecting members 162 can be connected with each other conveniently, in order to achieve assembled configuration of the plurality of second connecting members 162 and further facilitate the change of the sealing length of the sealing assembly 16.

Figure 8:
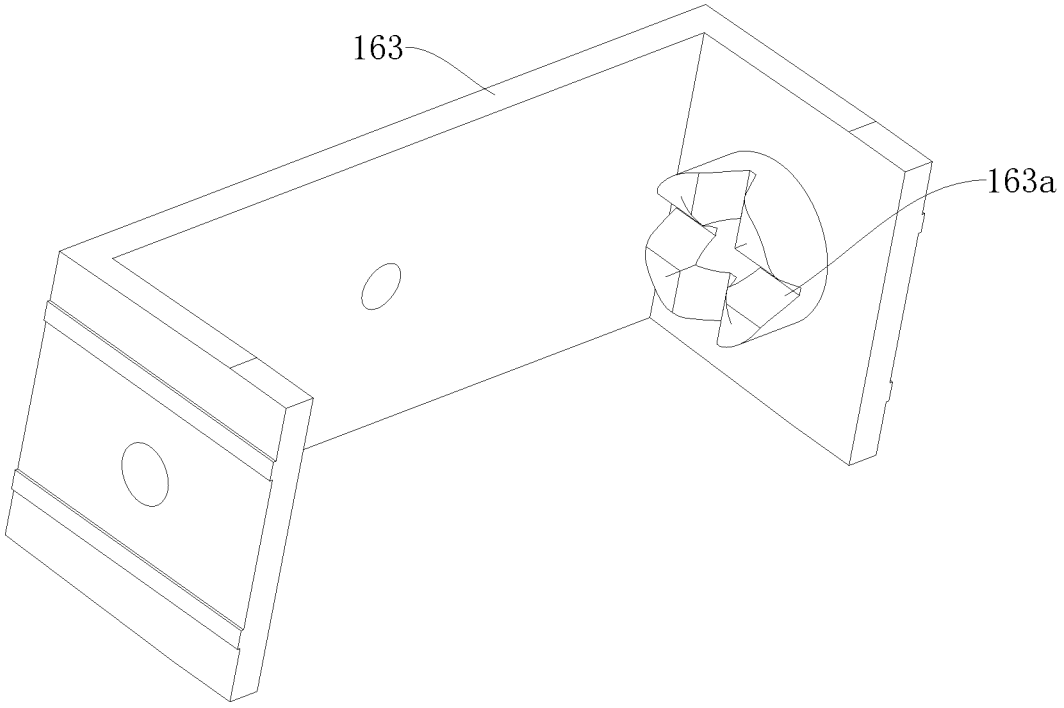
FIG. 8 is a perspective view of a rotating bracket of the sealing assembly in FIG. 7.

According to some optional embodiments of the present disclosure, referring to FIGS. 7 and 8, the sealing assembly 16 also includes a rotating bracket 163, and the rotating bracket 163 is fixed on the chassis 3. The fixing member 1611 is rotatably provided at the rotating bracket 163 so that the sealing assembly 16 can be rotated to be stored in the receiving groove s, which not only facilitates the installation and arrangement of the fixing member 1611, but also facilitates the rotation of the fixing member 1611 relative to the rotating bracket 163, in order to store the sealing assembly 16 and reduce a space occupied by the sealing assembly 16.

For example, in an embodiment of the present disclosure, referring to FIGS. 1 and 4-6, the window air conditioner 100 also includes an intermediate partition plate 4, and the intermediate partition plate 4 is fixed on the chassis 3 and located in the receiving groove s21. A front end and a rear end of the intermediate partition plate 4 are connected with the indoor part 1 and the outdoor part 2, respectively. The rotating bracket 163 is fixed to the intermediate partition plate 4, and the fixing member 1611 is rotatably arranged to the rotating bracket 163 so that the sealing assembly 16 can be rotated to be stored in the receiving groove s. Thus, with the intermediate partition plate 4, the connection strength between the indoor part 1 and the outdoor part 2 can be strengthened, a lower surface of the window can abut against the intermediate partition plate 4 to facilitate the wiring and drainage of the window air conditioner 100, thereby enhancing the working reliability of the window air conditioner 100. Moreover, since the fixing member 1611 is rotatably arranged to the rotating bracket 163, the sealing assembly 16 can be stored conveniently and the space occupied by the sealing assembly 16 can be reduced.

Figure 9:
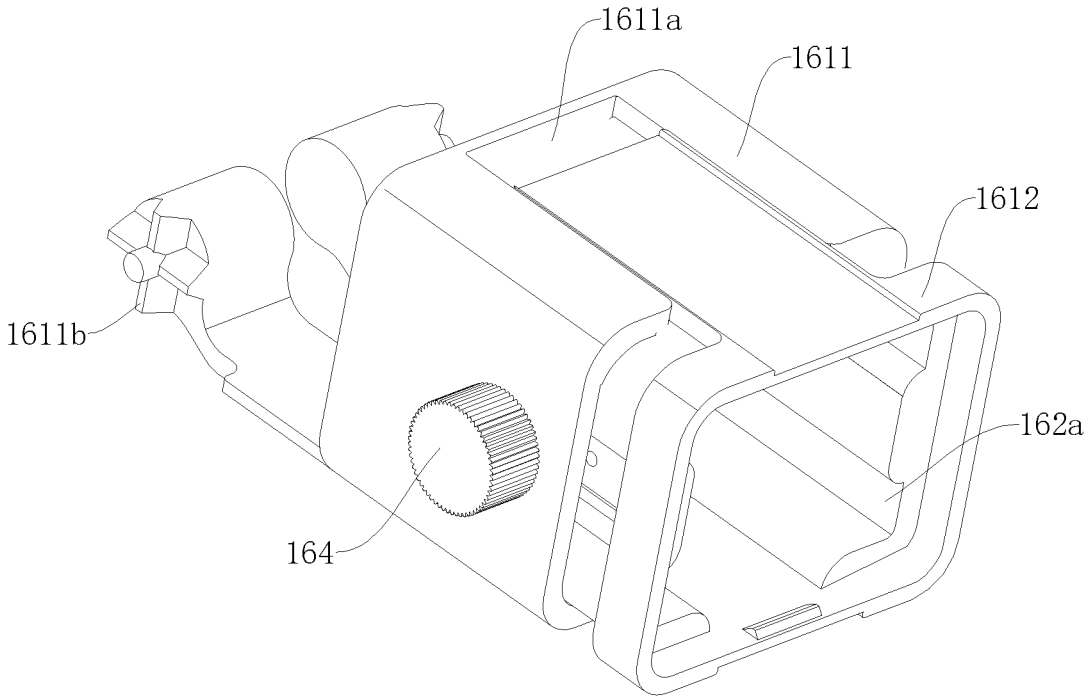
FIG. 9 is a perspective view of a first connecting member of the sealing assembly in FIG. 7.

Further, referring to FIGS. 7-9, the sealing assembly 16 also includes an angular positioning assembly, and the angular positioning assembly includes a positioning protrusion 1611*b* and a plurality of positioning recesses 163*a*. The positioning protrusion 1611*b* is provided at the fixing member 1611, and the plurality of positioning recesses 163*a* are provided in the rotating bracket 163 and arranged into a circular ring shape. When the rotating bracket 163 is rotated, the positioning protrusion 1611*b* can be switchably fitted with the plurality of positioning recesses 163*a*. When the positioning protrusion 1611*b* is fitted with one of the positioning recesses 163*a*, the fixing member 1611 is positioned. Thus, the fixing member 1611 can be positioned at a specific angle by providing the angular positioning assembly, and it is convenient for users to position the rotation angle of the fixing member 1611 according to requirements, thereby improving the performance of the sealing assembly 16. Moreover, with the angular positioning assembly being configured in the above-mentioned structure, the rotation angle of the fixing member 1611 can be positioned by the fitting between the positioning protrusion 1611*b* and the positioning recess 163*a*, and the fixing member 1611 can be positioned at different angles, so as to improve the positioning reliability and stability of the fixing member 1611.

Figure 10:
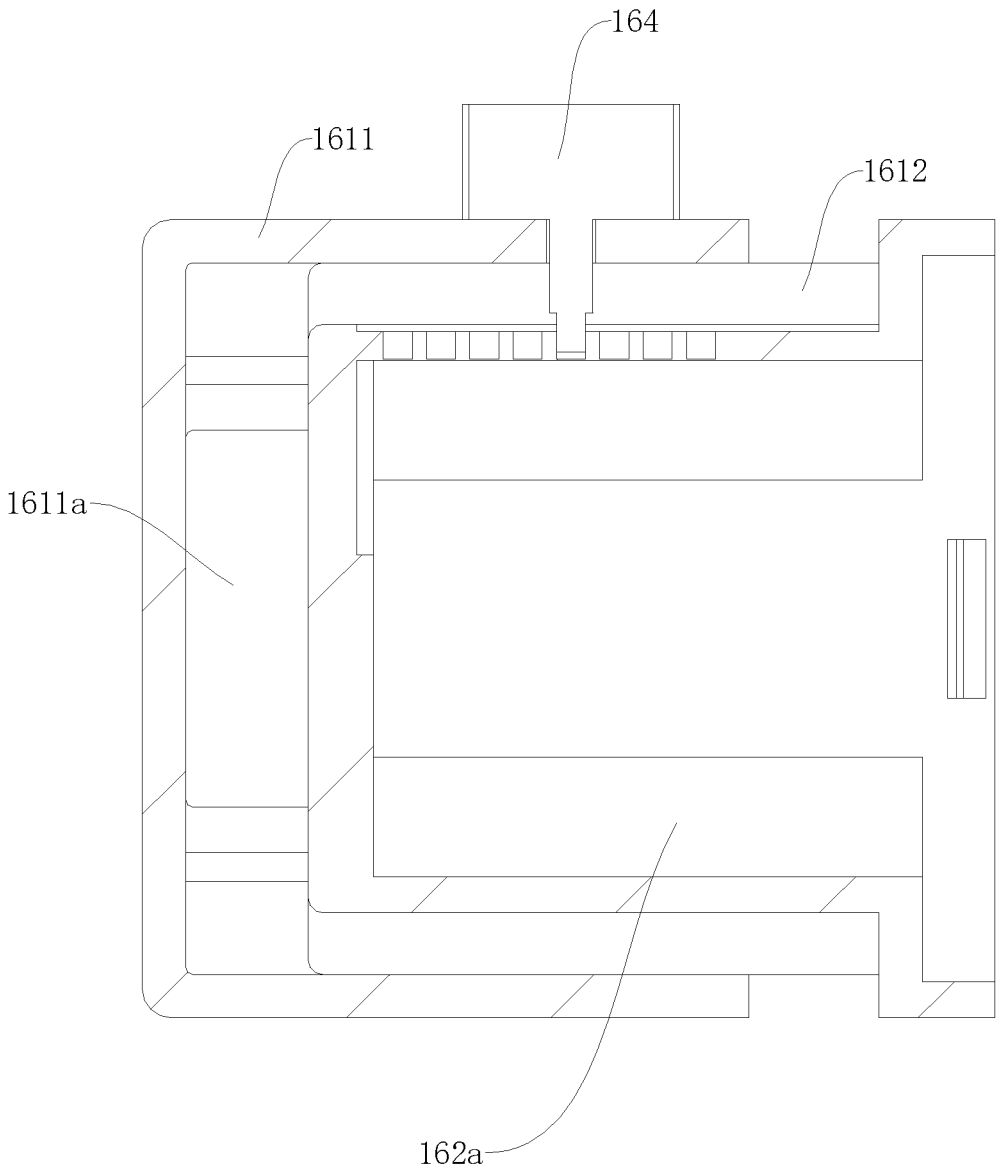
FIG. 10 is a schematic diagram illustrating that a fixing member and a slide block of the first connecting member in FIG. 9 cooperate with each other.
Figure 11:
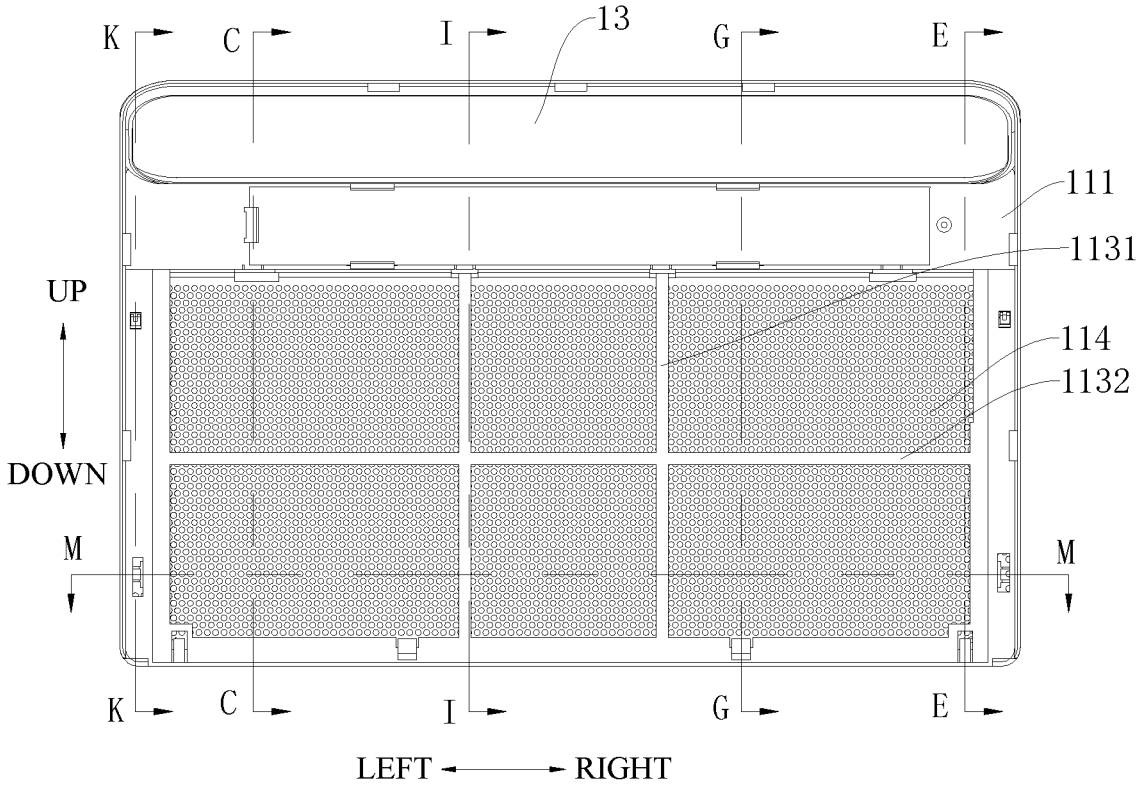
FIG. 11 is a rear view of a panel assembly according to the present disclosure.
Figure 12:
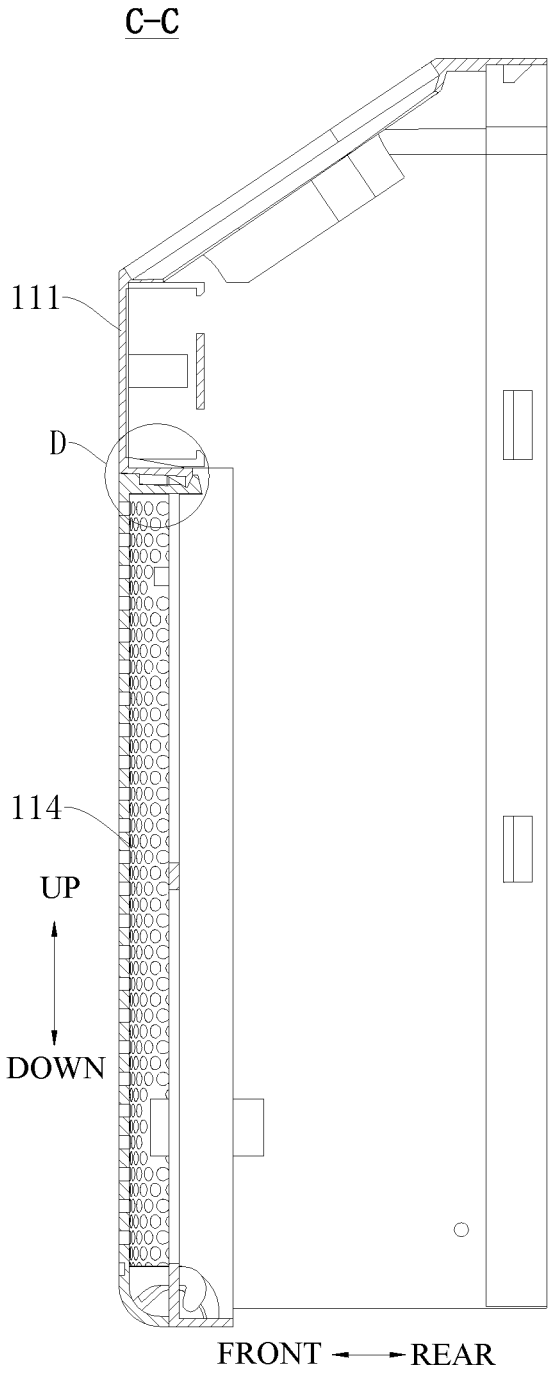
FIG. 12 is a sectional view along line C-C in FIG. 11.
Figure 13:
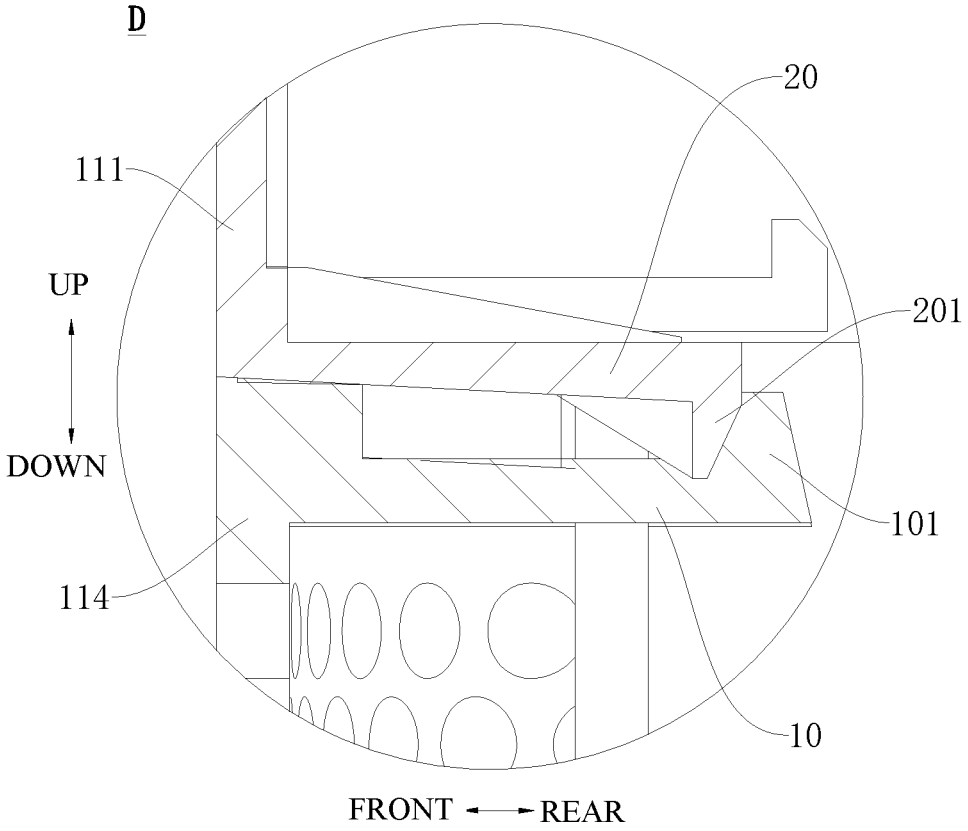
FIG. 13 is an enlarged view of part Din FIG. 12.

According to some optional embodiments of the present disclosure, referring to FIGS. 9 and 10, the sealing assembly 16 also includes a slide positioning assembly 164, and the slide positioning assembly 164 is provided at the fixing member 1611 and cooperates with the slide block 1612 to position the slide block 1612 in a current position. In this way, the slide block 1612 can be positioned by the slide positioning assembly 164, so that the sealing assembly 16 can be maintained at a specific sealing length, thereby improving the structural stability of the sealing assembly 16, and achieving the reliable sealing of the sealing assembly 16.

Optionally, referring to FIGS. 9 and 10, the fixing member 1611 is provided with a sliding cavity 1611*a*, and at least a part of the slide block 1612 extends into the sliding cavity 1611*a*. Thus, the fixing member 1611 and the slide block 1612 can cooperate and be arranged conveniently, thereby facilitating the sliding of the slide block 1611 relative to the fixing member 1611.

Further, referring to FIGS. 9 and 10, the slide positioning assembly 164 is a rotating member. The rotating member is rotatably provided through the fixing member 1611 and is threadedly fitted with the fixing member 1611. The rotating member rotates to adjust a length of a portion of the rotating member that extends into the sliding cavity 1611*a*. The rotating member can abut against the slide block 1612 to position the slide block 1612. In this way, the user can control whether the slide block 1612 can slide or not by rotating the rotating member, thereby allowing the user to adjust the length of the slide block 1612 conveniently according to requirements.

According to some optional embodiments of the present disclosure, referring to FIG. 7, the sealing assembly 16 also includes a sealing end cover 165 configured to seal an open end of the insertion chamber 162*a* farthest away from the fixing member 1611. Thus, not only the insertion chamber 162*a* farthest away from the fixing member 1611 can be sealed conveniently to improve the sealing property of the second connecting member 162, but also the plurality of second connecting members 162 can have the same structure, facilitating the processing and manufacturing of the second connecting members 162 and improving the interchangeability of the second connecting members 162.

Reference throughout this specification to "an embodiment," "some embodiments," "an exemplary embodiment," "an example," "a specific example," or "some examples," means that a particular feature, structure, material, or characteristic described in connection with the embodiment or example is included in at least one embodiment or example of the present disclosure. Thus, the illustrative descriptions in connection with the above terms throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that changes, modifications, alternatives and variations can be made in the embodiments without departing from the scope of the present disclosure. The scope of the present invention is defined by the claims and the like.

What is claimed is:

1. A panel assembly for an air conditioner, comprising:

a face frame including an air inlet and an air outlet located above the air inlet, an air outlet surface of the air outlet extending obliquely backward in a direction from bottom to top, and the air outlet surface being a plane on which an end surface of the air outlet is located;

an air inlet panel provided at the air inlet and including:

a first flange part at a top of the air inlet panel and extending backwards, the first flange part abutting against a top wall of the air inlet; and a second flange part at a bottom of the air inlet panel and extending backwards, the second flange part abutting against a front wall of the face frame to prevent the air inlet panel from moving towards the face frame along a horizontal direction; and a reinforcing support having a hollow structure and connected with the face frame, the reinforcing support being provided at the air inlet and located at an inner side of the air inlet panel, and including:

a plurality of first support rods spaced apart along a left-right direction, and each extending along an up-down direction; and at least one second support rod extending along the left-right direction and connected to each of the plurality of first support rods at a middle point of the each of the plurality of first support rods in terms of a length of the each of the plurality of first support rods.

2. The panel assembly according to claim 1, wherein an included angle between the air outlet surface and a vertical direction is larger than or equal to 50° and smaller than or equal to 66°.

3. The panel assembly according to claim 1, wherein the air inlet panel has a mesh structure and includes a plurality of air inlet holes.

4. The panel assembly according to claim 1, wherein:

the air inlet panel includes a plurality of first snaps arranged at an upper end of the air inlet panel and spaced apart along a left-right direction;

the face frame further includes a plurality of second snaps configured to be snapped with the plurality of first snaps in one-to-one correspondence, the second snaps being supported on the first snaps, respectively, and a snapping portion of each of the second snaps being located on a front side of and abutting a snapping portion of a corresponding one of the first snaps;

the air inlet panel further includes a plurality of third snaps arranged at a lower end of the air inlet panel and spaced apart along the left-right direction; and the face frame further includes a plurality of fourth snaps configured to be snapped with the third snaps in one-to-one correspondence, the third snaps being supported on the fourth snaps, respectively, and a snapping portion of each of the fourth snaps being located on a front side of and abutting a snapping portion of a corresponding one of the third snaps.

5. The panel assembly according to claim 4, wherein the snapping portion of one of the third snaps has a first guide surface, and the snapping portion of a corresponding one of the fourth snaps has a second guide surface cooperating with the first guide surface, both of the first guide surface and the second guide surface being configured as curved surfaces.

6. The panel assembly according to claim 1, wherein:

the air inlet panel includes a plurality of positioning columns distributed at a left end and a right end of the air inlet panel; and the face frame further includes a plurality of positioning holes configured to fit with the plurality of positioning columns in one-to-one correspondence.

7. The panel assembly according to claim 6, wherein:

one of the positioning columns includes a first limiting protrusion at an outer peripheral wall of the one of the positioning columns;

one of the positioning holes includes a second limiting protrusion at an inner peripheral wall of the one of the positioning holes; and the second limiting protrusion is located on a front side of the first limiting protrusion and is configured to abut the first limiting protrusion.

8. The panel assembly according to claim 1, wherein:

the air inlet further includes a plurality of first snaps arranged at a lower end of the air inlet panel and spaced apart along a left-right direction;

the face frame further includes a plurality of second snaps configured to be snapped with the plurality of first snaps in one-to-one correspondence, the plurality of first snaps being supported on the plurality of second snaps, respectively, and a snapping portion of each of the plurality of second snaps being located on a front side of and abutting a snapping portion of a corresponding one of the plurality of first snaps;

the snapping portion of one of the plurality of first snaps has a first guide surface, and the snapping portion of a corresponding one of the plurality of second snaps has a second guide surface cooperating with the first guide surface, both of the first guide surface and the second guide surface being configured as curved surfaces; and the first guide surface and the second guide surface bend in a same direction.

9. A panel assembly for an air conditioner, comprising:

a face frame including an air inlet and an air outlet located above the air inlet, an air outlet surface of the air outlet extending obliquely backward in a direction from bottom to top, and the air outlet surface being a plane on which an end surface of the air outlet is located; and an air inlet panel provided at the air inlet and including:

a first flange part at a top of the air inlet panel and extending backwards, the first flange part abutting against a top wall of the air inlet;

a second flange part at a bottom of the air inlet panel and extending backwards, the second flange part abutting against a front wall of the face frame to prevent the air inlet panel from moving towards the face frame along a horizontal direction; and a plurality of first snaps arranged at a lower end of the air inlet panel and spaced apart along a left-right direction;

wherein:

the face frame further includes a plurality of second snaps configured to be snapped with the plurality of first snaps in one-to-one correspondence, the plurality of first snaps being supported on the plurality of second snaps, respectively, and a snapping portion of each of the plurality of second snaps being located on a front side of and abutting a snapping portion of a corresponding one of the plurality of first snaps; and the snapping portion of one of the plurality of second snaps has a quarter circle shape with a short flat part on a top, a width of the short flat part being same as a thickness of the face frame, and the snapping portion of a corresponding one of the plurality of first snaps has a quarter circle ring shape cooperating with the snapping portion of the one of the plurality of second snaps.

* * * * *